US006814149B2

(12) United States Patent
Liess et al.

(10) Patent No.: US 6,814,149 B2
(45) Date of Patent: Nov. 9, 2004

(54) APPARATUS AND METHOD FOR POSITIONING A TUBULAR RELATIVE TO A TONG

(75) Inventors: Martin Liess, Seelze (DE); Jorg Erich Schulze-Beckinghausen, Garbsen (DE); Andreas Carlsson, Sehnde (DE); Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 62 days.

(21) Appl. No.: 10/146,599

(22) Filed: May 15, 2002

(65) Prior Publication Data

US 2002/0189804 A1 Dec. 19, 2002

Related U.S. Application Data

(63) Continuation-in-part of application No. 10/074,947, filed on Feb. 12, 2002, which is a continuation-in-part of application No. PCT/GB00/04383, filed on Nov. 17, 2000.

(51) Int. Cl.[7] ..... E21B 19/16; B25B 17/00

(52) U.S. Cl. ..... 166/380; 166/77.51; 166/85.5; 81/57.15; 81/57.18; 81/57.2

(58) Field of Search ..... 166/380, 77.51, 166/77.52, 85.5; 81/57.15, 57.16, 57.18, 57.2, 57.33, 57.34, 57.35

(56) References Cited

U.S. PATENT DOCUMENTS

| | | | | |
|---|---|---|---|---|
| 1,386,908 | A | 8/1921 | Taylor | |
| 1,842,638 | A | 1/1932 | Wigle | |
| 2,214,194 | A | 9/1940 | Frankley | 251/84 |
| 2,214,429 | A | 9/1940 | Miller | 166/16 |
| 2,522,444 | A | 9/1950 | Grable | 166/16 |
| 2,610,690 | A | 9/1952 | Beatty | 166/16 |
| 2,950,639 | A | 8/1960 | Mason | 81/53 |
| 3,021,739 | A | 2/1962 | Grundmann | 81/53 |
| 3,041,901 | A | 7/1962 | Knights | 81/53 |
| 3,086,413 | A | 4/1963 | Mason | 81/53 |
| 3,122,811 | A | 3/1964 | Gilreath | 24/263 |
| 3,131,586 | A | 5/1964 | Wilson | 81/52.4 |
| 3,180,186 | A | 4/1965 | Catland | 81/57 |
| 3,220,245 | A | 11/1965 | Winkle | 73/46 |
| 3,302,496 | A | 2/1967 | Mitchell et al. | 81/53 |
| 3,349,455 | A | 10/1967 | Doherty | 24/263 |
| 3,443,291 | A | 5/1969 | Doherty | 24/263 |
| 3,475,038 | A | 10/1969 | Matherne | 285/27 |
| 3,518,903 | A | 7/1970 | Ham et al. | 81/57.16 |
| 3,559,739 | A | 2/1971 | Hutchison | 166/311 |
| 3,680,412 | A | 8/1972 | Mayer et al. | 81/57.34 |
| 3,722,331 | A | 3/1973 | Radulescu | 81/52.4 |
| 3,747,675 | A | 7/1973 | Brown | 166/237 |

(List continued on next page.)

FOREIGN PATENT DOCUMENTS

| | | | |
|---|---|---|---|
| DE | 2 128 362 | 1/1972 | E21B/19/00 |
| EP | 0 285 386 | 5/1988 | E21B/19/16 |
| EP | 0 339 005 | 10/1989 | E21B/19/16 |

(List continued on next page.)

OTHER PUBLICATIONS

PCT International Search Report, International Application No. PCT/US 03/03195, dated Oct. 22, 2003.

*Primary Examiner*—David Bagnell
*Assistant Examiner*—Shane Bomar
(74) *Attorney, Agent, or Firm*—Moser, Patterson & Sheridan, L.L.P.

(57) ABSTRACT

An apparatus and a method for positioning a tubular relative to a tong is provided. In one aspect, a positioning tool may be mounted on a lower portion of the tong. The positioning tool includes a positioning member for determining a position of the tubular and a centering member for engaging the tubular. The positioning tool further includes an actuation device for actuating the centering member. The position of the tubular may be actively adjusted by actuating the centering member.

33 Claims, 23 Drawing Sheets

U.S. PATENT DOCUMENTS

| | | | | | |
|---|---|---|---|---|---|
| 3,796,418 | A | | 3/1974 | Carlberg | 269/26 |
| 3,808,916 | A | | 5/1974 | Porter et al. | 81/57.19 |
| 3,838,613 | A | | 10/1974 | Wilms | 81/57.34 |
| 3,933,108 | A | | 1/1976 | Baugh | 114/5 D |
| 3,941,348 | A | | 3/1976 | Mott | 251/58 |
| 3,986,564 | A | | 10/1976 | Bender | 173/4 |
| 4,005,621 | A | | 2/1977 | Turner, Jr. et al. | 81/57.2 |
| 4,023,449 | A | * | 5/1977 | Boyadjieff | 81/57.16 |
| 4,142,739 | A | | 3/1979 | Billingsley | 285/18 |
| 4,159,637 | A | | 7/1979 | Lamb et al. | 73/46 |
| 4,170,908 | A | | 10/1979 | Peveto et al. | 81/57.11 |
| 4,202,225 | A | * | 5/1980 | Sheldon et al. | 81/57.35 |
| 4,221,269 | A | | 9/1980 | Hudson | 173/163 |
| 4,246,809 | A | | 1/1981 | Keast et al. | 81/57.16 |
| 4,257,442 | A | | 3/1981 | Claycomb | 137/238 |
| 4,262,693 | A | | 4/1981 | Giebeler | 137/494 |
| 4,291,762 | A | | 9/1981 | Gudgel | 166/85 |
| 4,295,527 | A | | 10/1981 | Russe | 166/135 |
| 4,315,553 | A | | 2/1982 | Stallings | 175/207 |
| 4,334,444 | A | | 6/1982 | Carstensen et al. | 81/57.18 |
| 4,346,629 | A | | 8/1982 | Kinzbach | 81/57.2 |
| 4,401,000 | A | | 8/1983 | Kinzbach | 81/57.2 |
| 4,402,239 | A | | 9/1983 | Mooney | 81/57.16 |
| 4,403,666 | A | * | 9/1983 | Willis | 175/85 |
| 4,442,892 | A | | 4/1984 | Delesandri | 166/85 |
| RE31,699 | E | | 10/1984 | Eckel | 73/862.25 |
| 4,492,134 | A | | 1/1985 | Reinholdt et al. | 81/57.34 |
| 4,499,919 | A | | 2/1985 | Forester | 137/613 |
| 4,565,003 | A | | 1/1986 | McLeod | 29/281.1 |
| 4,572,036 | A | * | 2/1986 | Renfro | 81/57.2 |
| 4,573,359 | A | | 3/1986 | Carstensen | 73/761 |
| 4,593,773 | A | | 6/1986 | Skeie | 175/85 |
| 4,643,259 | A | | 2/1987 | Zeringue, Jr. | 166/77.5 |
| 4,648,292 | A | * | 3/1987 | Haynes et al. | 81/57.16 |
| 4,649,777 | A | | 3/1987 | Buck | 81/57.19 |
| 4,709,766 | A | | 12/1987 | Boyadjieff | 175/52 |
| 4,712,284 | A | | 12/1987 | Coyle, Sr. et al. | 29/240 |
| 4,715,625 | A | | 12/1987 | Shows, Jr. et al. | 285/145 |
| 4,773,218 | A | | 9/1988 | Wakita et al. | 60/476 |
| 4,811,635 | A | | 3/1989 | Falgout, Sr. | 81/57.33 |
| 4,821,814 | A | * | 4/1989 | Willis et al. | 173/164 |
| 4,895,056 | A | * | 1/1990 | Schulze-Beckinghausen | 81/57.17 |
| 4,938,109 | A | | 7/1990 | Torres et al. | 81/467 |
| 4,979,356 | A | | 12/1990 | Vatne | 81/57.16 |
| 5,000,065 | A | | 3/1991 | Haynes | 81/57.2 |
| 5,022,472 | A | | 6/1991 | Bailey et al. | 175/195 |
| 5,044,232 | A | | 9/1991 | Schulze-Beckinghausen | 81/57.18 |
| 5,054,550 | A | * | 10/1991 | Hodge | 166/78.1 |
| 5,092,399 | A | | 3/1992 | Lang | 166/77.5 |
| 5,150,642 | A | | 9/1992 | Moody et al. | 81/57.2 |
| 5,159,860 | A | | 11/1992 | Pietras | 81/57.19 |
| 5,161,438 | A | | 11/1992 | Pietras | 81/57.16 |
| 5,167,173 | A | | 12/1992 | Pietras | 81/57.15 |
| 5,172,613 | A | * | 12/1992 | Wesch, Jr. | 81/57.33 |
| 5,207,128 | A | * | 5/1993 | Albright | 81/57.18 |
| 5,209,302 | A | | 5/1993 | Robichaux et al. | 166/355 |
| 5,221,099 | A | | 6/1993 | Jansch | 279/151 |
| 5,259,275 | A | | 11/1993 | Schulze-Beckinghausen | 81/57.16 |
| 5,297,833 | A | | 3/1994 | Willis et al. | 294/102.2 |
| 5,390,568 | A | | 2/1995 | Pietras | 81/57.16 |
| 5,451,084 | A | | 9/1995 | Jansch | 294/1.1 |
| 5,520,072 | A | | 5/1996 | Perry | 81/57.16 |
| 5,634,671 | A | | 6/1997 | Watkins | 285/18 |
| 5,667,026 | A | * | 9/1997 | Lorenz et al. | 175/162 |
| 5,706,893 | A | | 1/1998 | Morgan | 166/86.1 |
| 5,730,471 | A | | 3/1998 | Schulze-Beckinghausen et al. | 285/18 |
| 5,746,276 | A | | 5/1998 | Stuart | 173/1 |
| 5,787,982 | A | | 8/1998 | Bakke | 166/242.6 |
| 5,819,605 | A | | 10/1998 | Buck et al. | 81/57.33 |
| 5,839,330 | A | | 11/1998 | Stokka | 81/57.33 |
| 5,842,390 | A | | 12/1998 | Bouligny et al. | 81/57.34 |
| 5,845,549 | A | | 12/1998 | Bouligny | 81/57.33 |
| 5,890,549 | A | | 4/1999 | Sprehe | 175/71 |
| 5,992,801 | A | | 11/1999 | Torres | 248/49 |
| 6,065,372 | A | | 5/2000 | Rauch | 81/57.15 |
| 6,082,224 | A | | 7/2000 | McDaniels et al. | 81/57.15 |
| 6,082,225 | A | | 7/2000 | Richardson | 81/57.16 |
| 6,116,118 | A | * | 9/2000 | Wesch, Jr. | 81/57.34 |
| 6,119,772 | A | | 9/2000 | Pruet | 166/81.1 |
| 6,138,529 | A | | 10/2000 | Pietras | 81/57.33 |
| 6,142,041 | A | * | 11/2000 | Buck | 81/57.35 |
| 6,161,617 | A | | 12/2000 | Gjedebo | 166/77.52 |
| 6,206,096 | B1 | | 3/2001 | Belik | 166/77.51 |
| 6,223,629 | B1 | | 5/2001 | Bangert | 81/57.15 |
| 6,253,845 | B1 | * | 7/2001 | Belik | 166/77.51 |
| 6,305,720 | B1 | | 10/2001 | Spiering et al. | 285/18 |
| 6,327,938 | B1 | | 12/2001 | Pietras | 81/57.33 |
| 6,330,911 | B1 | | 12/2001 | Allen et al. | 166/77.51 |
| 6,360,633 | B2 | | 3/2002 | Pietras | 81/57.34 |
| 6,412,554 | B1 | | 7/2002 | Allen et al. | 166/80.1 |
| 6,480,811 | B2 | | 11/2002 | Denny et al. | 702/188 |

FOREIGN PATENT DOCUMENTS

| | | | | |
|---|---|---|---|---|
| EP | 0 311 455 | | 12/1989 | E21B/19/16 |
| EP | 0 423 055 | | 4/1991 | E21B/17/043 |
| EP | 0 525 247 | | 3/1993 | E21B/3/02 |
| GB | 1 215 967 | | 12/1970 | B25B/13/50 |
| GB | 2 049 518 | | 12/1980 | E21B/19/16 |
| GB | 2 128 526 | | 5/1984 | E21B/19/16 |
| GB | 2 300 896 | A | 11/1996 | F16K/3/08 |
| GB | 2 346 576 | | 8/2000 | E21B/19/16 |
| GB | 2 346 577 | | 8/2000 | E21B/19/16 |
| WO | WO 83/03443 | | 10/1983 | E21B/19/16 |
| WO | WO 92/18744 | | 10/1992 | E21B/19/16 |
| WO | WO 93/18276 | | 9/1993 | E21B/19/16 |
| WO | WO 95/20471 | | 8/1995 | B25B/17/00 |
| WO | WO 98/16716 | | 4/1998 | E21B/21/00 |
| WO | WO 98/32948 | | 7/1998 | E21B/19/16 |
| WO | WO 99/34089 | | 7/1999 | E21B/19/16 |
| WO | WO 99/34090 | | 7/1999 | E21B/21/00 |
| WO | WO 99/34091 | | 7/1999 | E21B/21/00 |
| WO | WO 00/22278 | | 4/2000 | E21B/19/16 |
| WO | WO 00/23686 | | 4/2000 | E21B/19/16 |
| WO | WO 00/45026 | | 8/2000 | E21B/19/16 |
| WO | WO 00/45027 | | 8/2000 | E21B/19/16 |
| WO | WO 00/79092 | | 12/2000 | E21B/21/08 |
| WO | WO 01/03889 | A1 | 1/2001 | B25B/17/00 |
| WO | WO 01/09479 | | 2/2001 | E21B/19/16 |
| WO | WO 01/38688 | | 5/2001 | E21B/19/16 |
| WO | WO 01/66905 | A3 | 9/2001 | E21B/19/16 |

* cited by examiner

APPARATUS AND METHOD FOR POSITIONING A TUBULAR RELATIVE TO A TONG

CROSS-REFERENCE TO RELATED APPLICATIONS

This application is a continuation-in-part of U.S. patent application Ser. No. 10/074,947 filed on Feb. 12, 2002, which is a continuation-in-part of co-pending International Application No. PCT/GB00/04383 having an international filing date of Nov. 17, 2000, and published in English on May 31, 2001 in accordance with Patent Cooperation Treaty Convention Article 21(2). These copending applications are herein incorporated by reference in their entirety.

BACKGROUND OF THE INVENTION

1. Field of the Invention

The present invention generally relates to a wrenching tong and other power tongs. Particularly, the present invention relates to a wrenching tong for use in making or breaking tubular connections. More particularly still, the present invention relates to a tong which has been adapted to reduce the likelihood that it will damage pipe connections.

2. Description of the Related Art

In the construction of oil or gas wells it is usually necessary to construct long drill pipes. Due to the length of these pipes, sections or stands of pipe are progressively added to the pipe as it is lowered into the well from a drilling platform. In particular, when it is desired to add a section or stand of pipe the string is usually restrained from falling into the well by applying the slips of a spider located in the floor of the drilling platform. The new section or stand of pipe is then moved from a rack to the well center above the spider. The threaded pin of the section or stand of pipe to be connected is then located over the threaded box of the pipe in the well and the connection is made up by rotation therebetween. An elevator is connected to the top of the new section or stand and the whole pipe string lifted slightly to enable the slips of the spider to be released. The whole pipe string is then lowered until the top of the section is adjacent the spider whereupon the slips of the spider are re-applied, the elevator disconnected and the process repeated.

It is common practice to use a power tong to torque the connection up to a predetermined torque in order to make this connection. The power tong is located on the platform, either on rails, or hung from a derrick on a chain. In order to make up or break out a threaded connection, a two tong arrangement is necessary. An active (or wrenching) tong supplies torque to the section of pipe above the threaded connection, while a passive (or back up) tong supplies a reaction torque below the threaded connection. The back up tong clamps the pipe below the threaded connection, and prevents it from rotating. This clamping can be performed mechanically, hydraulically or pneumatically. The wrenching tong clamps the upper part of the connection and is driven so that it supplies torque for a limited angle.

This power tong arrangement is also used to torque up connections between other tubulars, for example casing and tubing.

Normally, in order to supply high torque, the wrenching tong is driven hydraulically. One or two hydraulic cylinders drive the tong through a small angle, typically in the region of 25°, depending on the tong design. Due to the geometric configuration normally used, the torque output of the tong changes as a sine function of the angle driven, which results in a reduction of torque output across the drive angle of up to 15%.

In order to make up or break out a connection of modem drill pipe or casing, high torque must be supplied over a large angle. This angle is sometimes six times higher than a conventional wrenching tong can supply. In order to overcome this, the wrenching tong must grip and wrench the tubular several times to tighten or break the threaded connection fully. This has a number of disadvantages. The action of gripping and releasing the pipe repeatedly can damage the pipe surface. Due to the high costs associated with the construction of oil and gas wells, time is critical, and the repeated clamping and unclamping of the wrenching tong greatly increases the time taken to attach each new section or stand of tubulars. It also has the effect that the torque provided is discontinuous, increasing the difficulty of accurately controlling the torque with respect to the angle turned.

Further, the drill pipe may be damaged if the torque applied is above the predetermined torque for making or breaking the connection. Generally, drill pipe connections are designed to makeup or breakup at a predetermined torque. Thus, if too much torque is applied, the connection may be damaged. Conversely, if insufficient torque applied, then the drill pipes may not be properly connected.

Therefore, there is a need for an improved apparatus for making or breaking a tubular connection. Further, there is a need for an apparatus that will makeup or breakup a tubular connection with minimal gripping and releasing action. Further still, there is a need for an apparatus for monitoring and controlling the torque applied to making or breaking a tubular connection.

SUMMARY OF THE INVENTION

According to a first aspect of the present invention there is provided apparatus for applying torque to a first tubular relative to a second tubular, the apparatus comprising a first tong for gripping the first tubular and a second tong for gripping the second tubular, wherein the first tong is provided with teeth around a peripheral surface thereof, the second tong is provided with at least one pinion, and the pinion meshes with the teeth in such a way that the first tong and the second tong can be rotated relative to one another when the pinion is rotated.

Preferably the first tong is a back-up tong and the second tong is a wrenching tong. Both tongs are preferably substantially cylindrical, and an axial passage is preferably provided therethrough for receiving tubulars. A passage is preferably provided from a peripheral edge to the axial passage of each tong to allow the introduction of tubulars into the axial passage. The pinion is preferably located at or near the periphery of the second tong. A motor may be provided on the second tong and coupled to the at least one pinion.

The second tong is preferably provided with two pinions, although in another embodiment it may be provided with only one. The pinions are preferably located at or near the periphery of the second tong spaced by substantially 180° about the longitudinal axis of the tong. In another embodiment they may be spaced by substantially 120° about the longitudinal axis of the tong.

Preferably, the first tong comprises a plurality of hydraulically driven clamping jaws for gripping the first tubular and the second tong comprises a plurality of hydraulically driven clamping jaws for gripping the second tubular. Each jaw may be equipped with two or more dies, and is preferably attached to hydraulic driving means via a spherical bearing, although the jaw may be an integral part of the hydraulic driving means.

Bearings supported on resilient means are preferably provided between the first tong and the second tong to facilitate relative axial movement of the first and second tongs.

According to a second aspect of the present invention there is provided apparatus for applying torque to a first tubular relative to a second tubular, the apparatus comprising a gear and at least one pinion, and first clamping means for clamping the first tubular within the gear, the pinion being attached to second clamping means for clamping the second tubular, and the pinion meshing with the gear in such a way that the first clamping means and the second clamping means can be rotated relative to one another by rotating the pinion.

The first clamping means preferably comprise jaws mounted within the gear about an axial passage extending through the gear. The second clamping means preferably comprises jaws mounted within a clamping housing about an axial passage extending therethrough. A motor is preferably fixed to the clamping housing and coupled to the or each pinion.

According to a third aspect of the present invention there is provided a method of applying torque to a first tubular relative to a second tubular, the method comprising: clamping the first tubular in a first tong; clamping the second tubular in a second tong; and rotating a pinion connected to the second tong and which meshes with teeth provided around a peripheral surface of the first tong so as to rotate the first tong relative to the second tong.

According to a fourth aspect of the present invention there is provided a method of coupling a tool to a length of tubular, the method comprising the steps of:

securing the tool in a basket;

lowering a tong arrangement having a rotary part and a stationary part, relative to the basket to engage respective locking members of the tong arrangement and the basket, thereby fixing the basket and the tool relative to the stationary part of the tong arrangement; and rotating the length of tubular using the rotary part of the tong arrangement so as to couple the tool to the length of tubular.

This method may be used to couple a tool such as a drill bit, to a length of drill pipe. The coupling portion of the length of drill pipe may be brought into proximity with a corresponding coupling portion of the tool either before or after the lowering of the tong arrangement.

The length of drill string may be gripped by the rotary part of the tong arrangement either before or after the lowering of the tong arrangement. The length of drill string may be located proximate to the basket containing the tool either before or after the string is gripped by the rotary part of the tong arrangement.

By carrying out the steps of the above fourth aspect of the present invention in reverse (including rotating the length of tubing in the opposite direction), a tool may be decoupled from a length of tubular.

According to a fifth aspect of the present invention there is provided apparatus for enabling a tool to be secured to a length of drill pipe, the apparatus comprising:

a basket arranged to securely retain the tool;

a tong arrangement having a rotary portion and a stationary portion, the rotary portion being arranged in use to grip and rotate the length of tubular; and first locking means provided on the basket and second locking means provided on the stationary portion of the tong arrangement, the first and second locking means being engageable with one another to fix the basket relative to the stationary portion of the tong arrangement.

Preferably the first and second locking means are engageable and disengageble by means of linear movement of the tong arrangement relative to the basket.

Preferably, the basket is arranged to prevent rotation of the tool in the basket, wherein in use the rotary portion of the tong arrangement may be used to rotate the length of drill pipe to secure a screw connection between the length of drill pipe and the tool.

Preferably, one of the first and second locking means comprises one or more slots, and the other of the first and second locking means comprises one or more projecting members, the slots and the members being engageable and disengageable by relative linear movement of the tong arrangement and the basket.

According to a sixth aspect of the present invention there is provided a tong for use in clamping a length of tubular during the making up or breaking out of a connection, the tong comprising:

a body portion having a central opening therein for receiving a length of tubular; and at least two clamping mechanisms mounted in said body, the clamping mechanisms being radially spaced about said opening;

a plurality of elongate mounting members disposed between each of the clamping mechanisms and the body of the tong, each mounting member having a flat face for abutting a side of a clamping mechanism and a rounded side for locating in a complimentary shaped recess in the tong body, wherein each tong may be displaced to some extent from radial alignment with the central opening of the tong.

The present invention provides a positioning apparatus for determining the position of a tubular with respect to the tong. The positioning apparatus includes a plunger having an end contactable with the tubular disposed on a base. The plunger may be coupled to a visual indicator to indicate the axial travel of the plunger relative to the base.

In another aspect, the present invention provides a torque measuring flange for determining the torque applied by a motor to the tong. The flange includes a top plate and a bottom plate. The flange further includes one or more wedges disposed about the periphery of the flange. Preferably, two wedges are attached to the top plate and two wedges are attached to the bottom plate. One or more cylinders may be disposed between two wedges, whereby compressing the two wedges causes a piston in the cylinder to compress.

In another aspect, the present invention provides a positioning tool for positioning a tubular relative to a tong. The positioning tool includes a positioning member for determining a position of the tubular and a centering member for engaging the tubular. The positioning tool further includes means for actuating the centering member. The position of the tubular may be actively adjusted by actuating the centering member.

In another aspect, the present invention provides a method for positioning a tubular relative to a tong. The method includes engaging the tubular with a positioning member, moving the positioning member, and moving the tong.

In another aspect still, the positioning tool may further include a joint detection member. Preferably, the joint detection member includes a proximity sensor connected to a computer or other programmable medium.

BRIEF DESCRIPTION OF THE DRAWINGS

So that the manner in which the above recited features and advantages of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
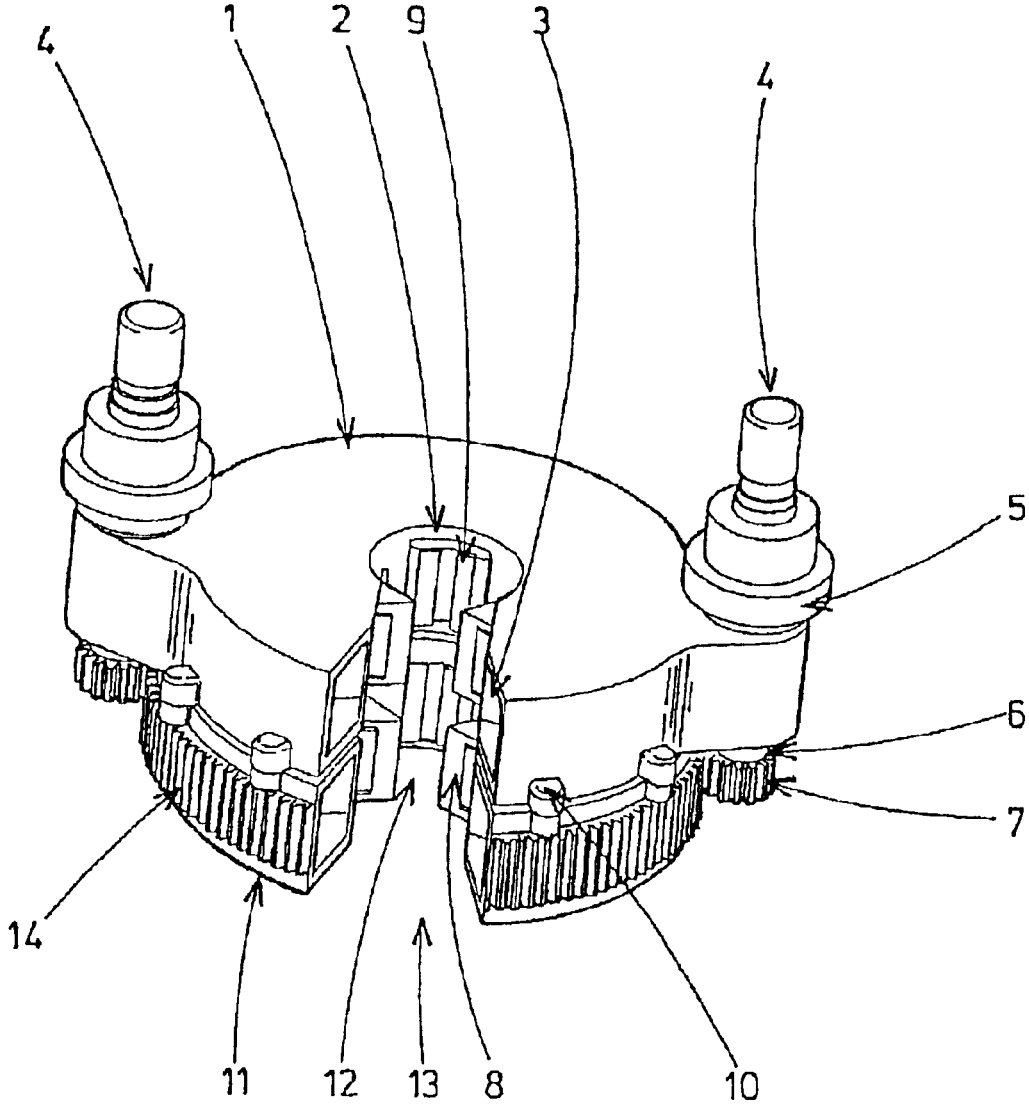
Figure 2:
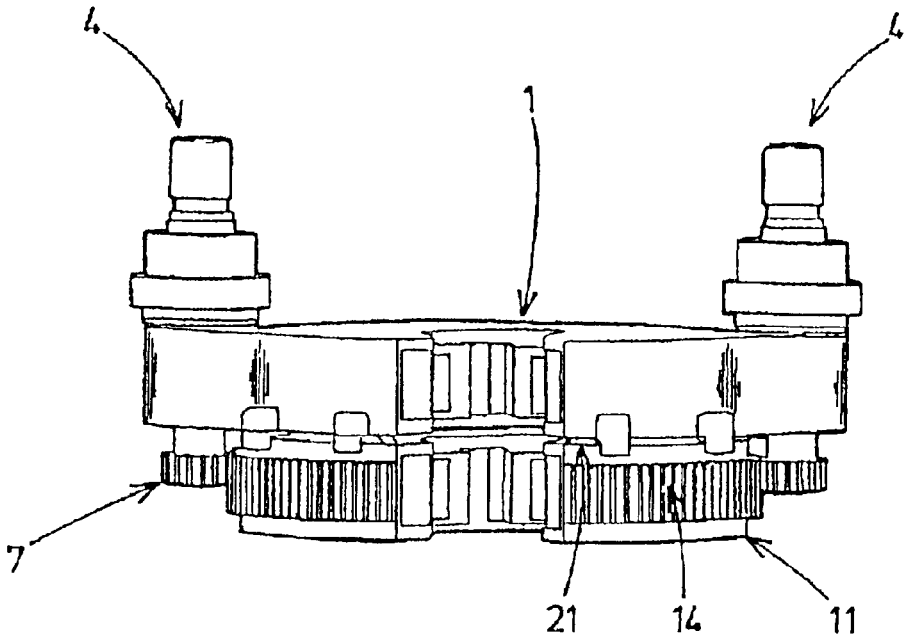
Figure 3:
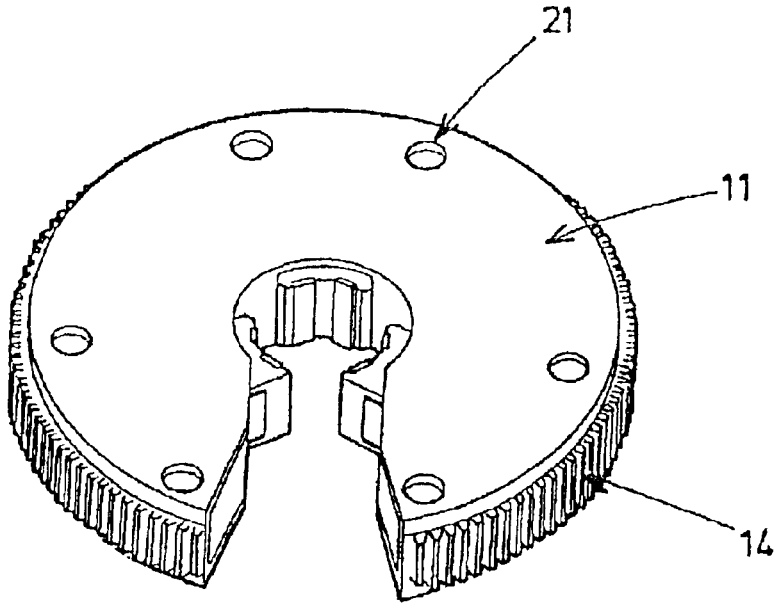
Figure 4:
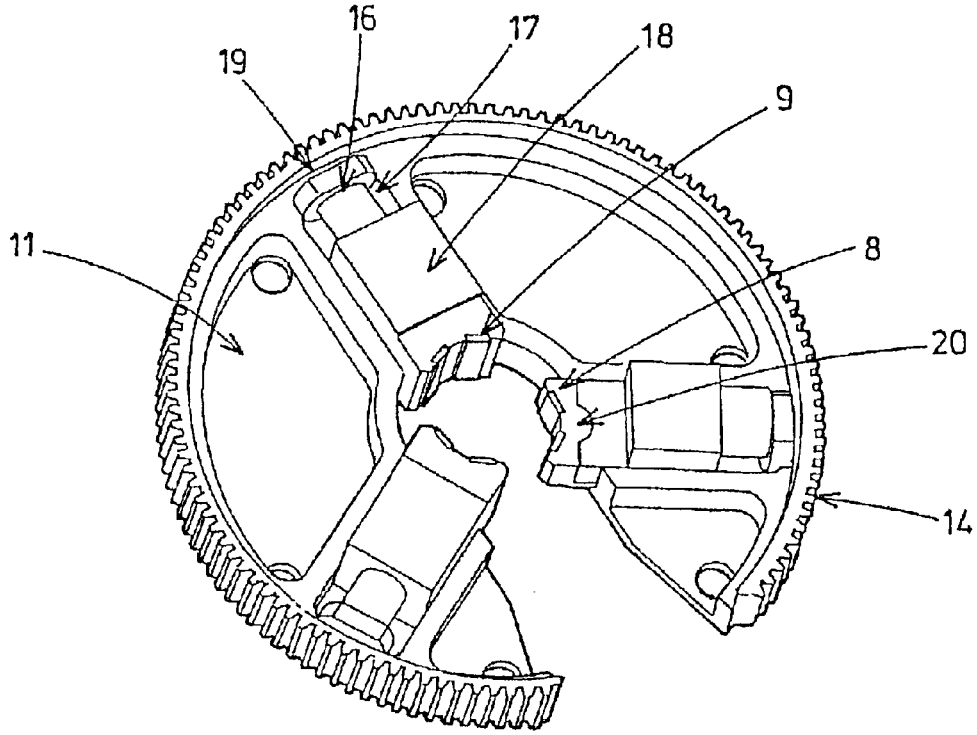
Figure 5:
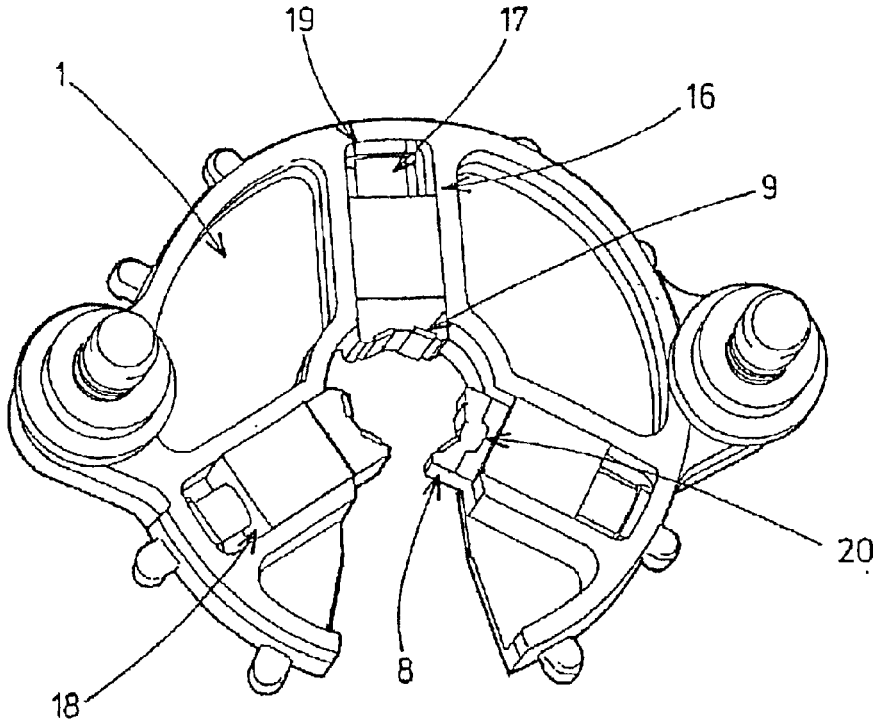
Figure 6:
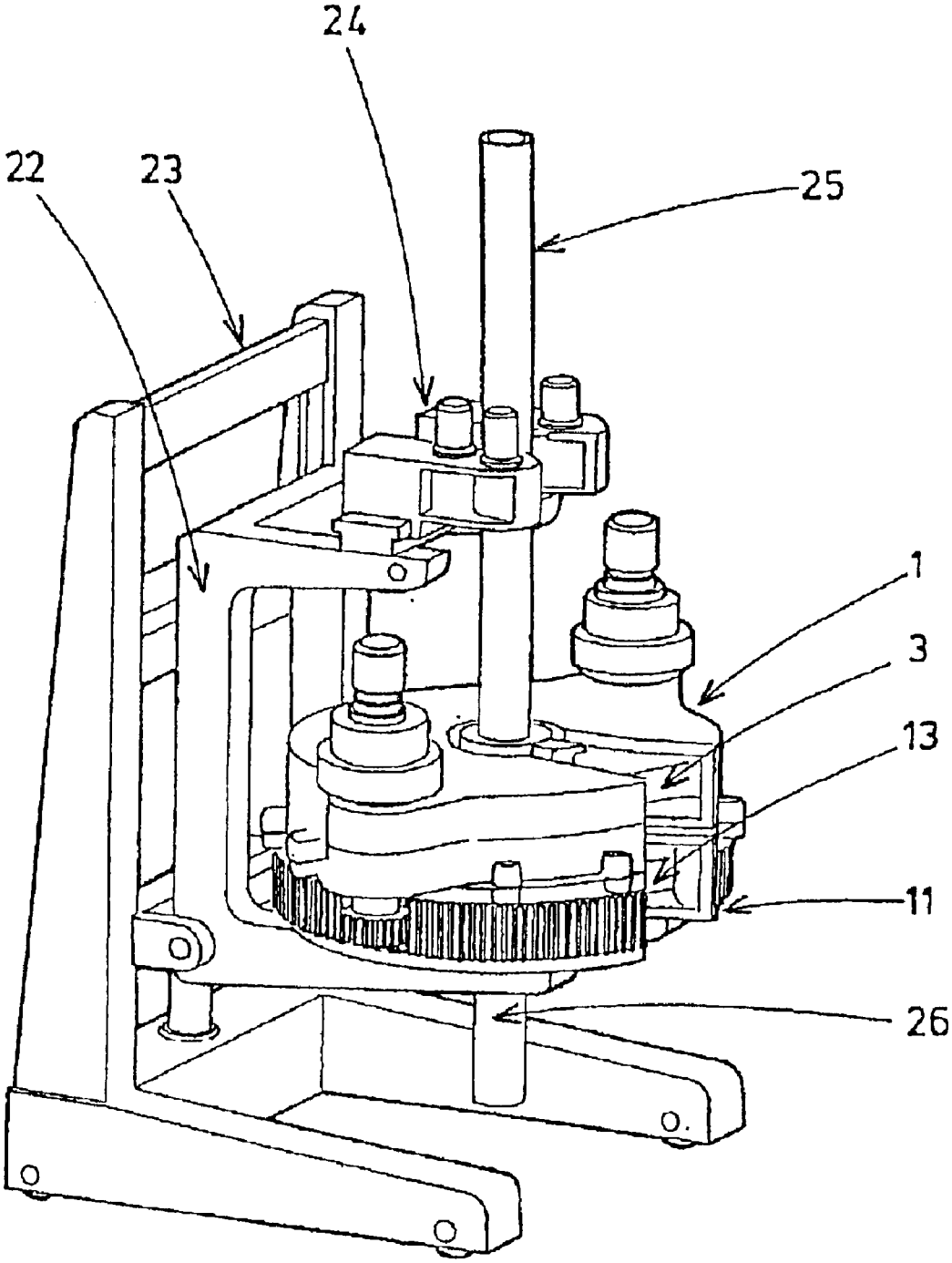
Figure 7:
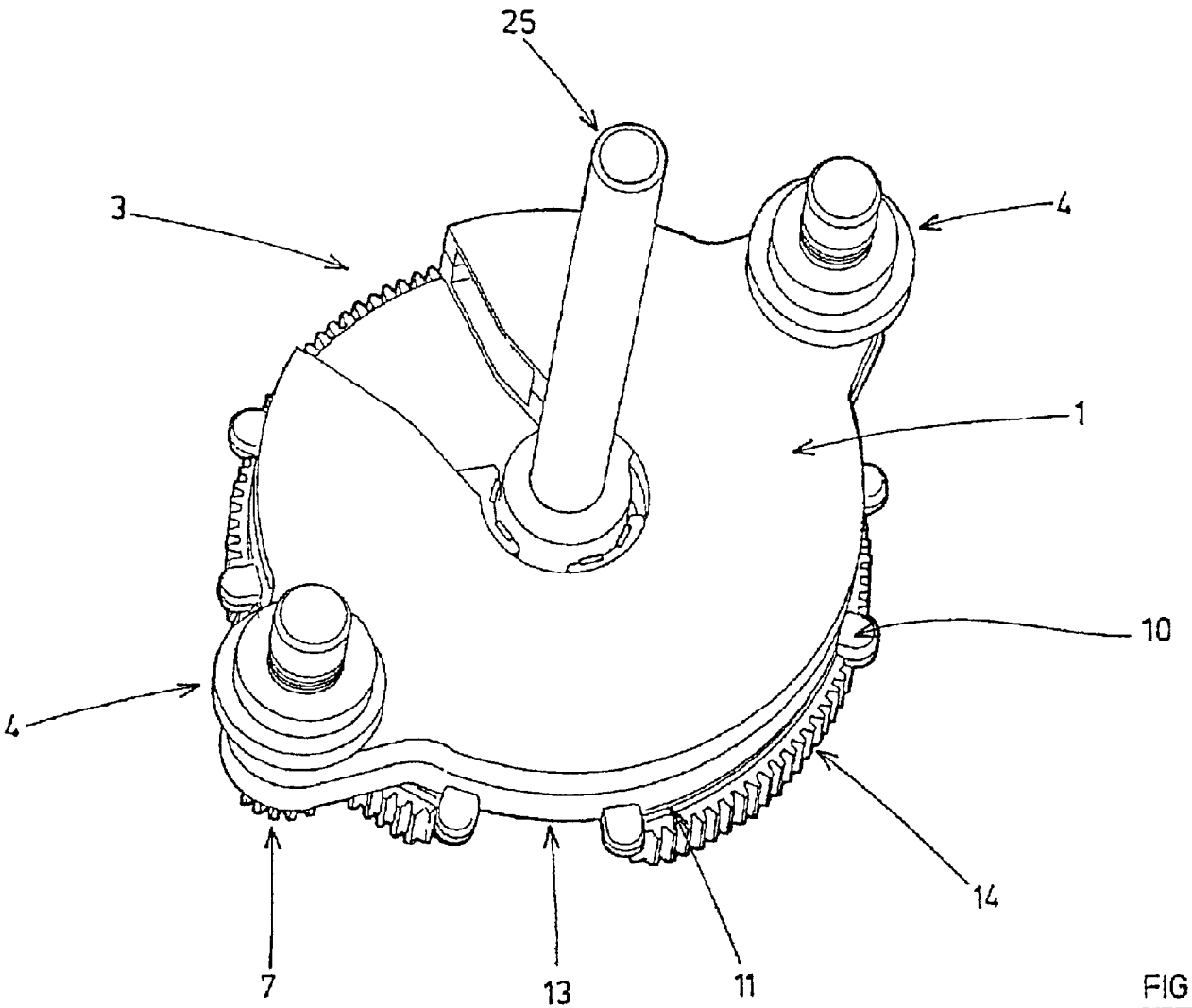
Figure 8:
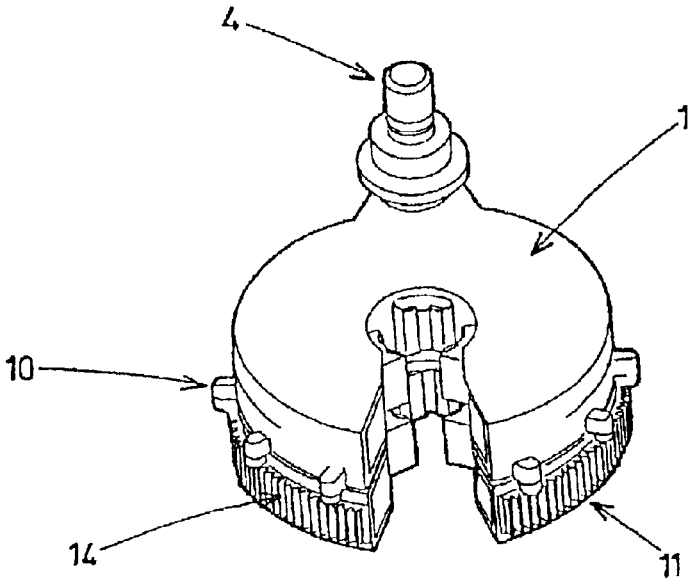
Figure 9:
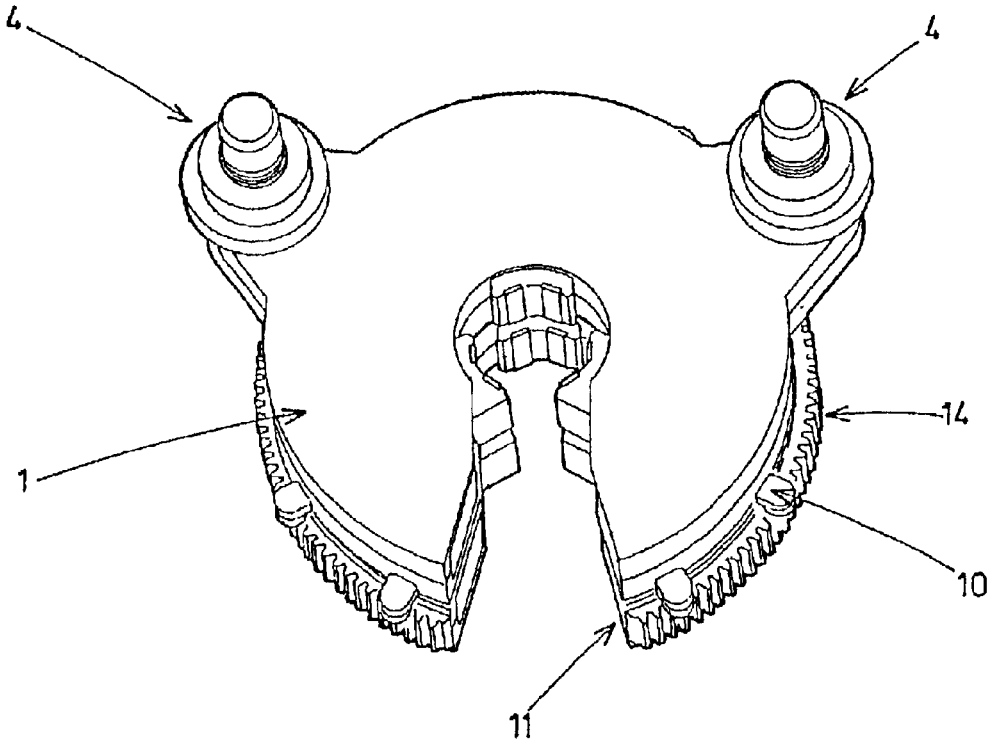
Figure 10:
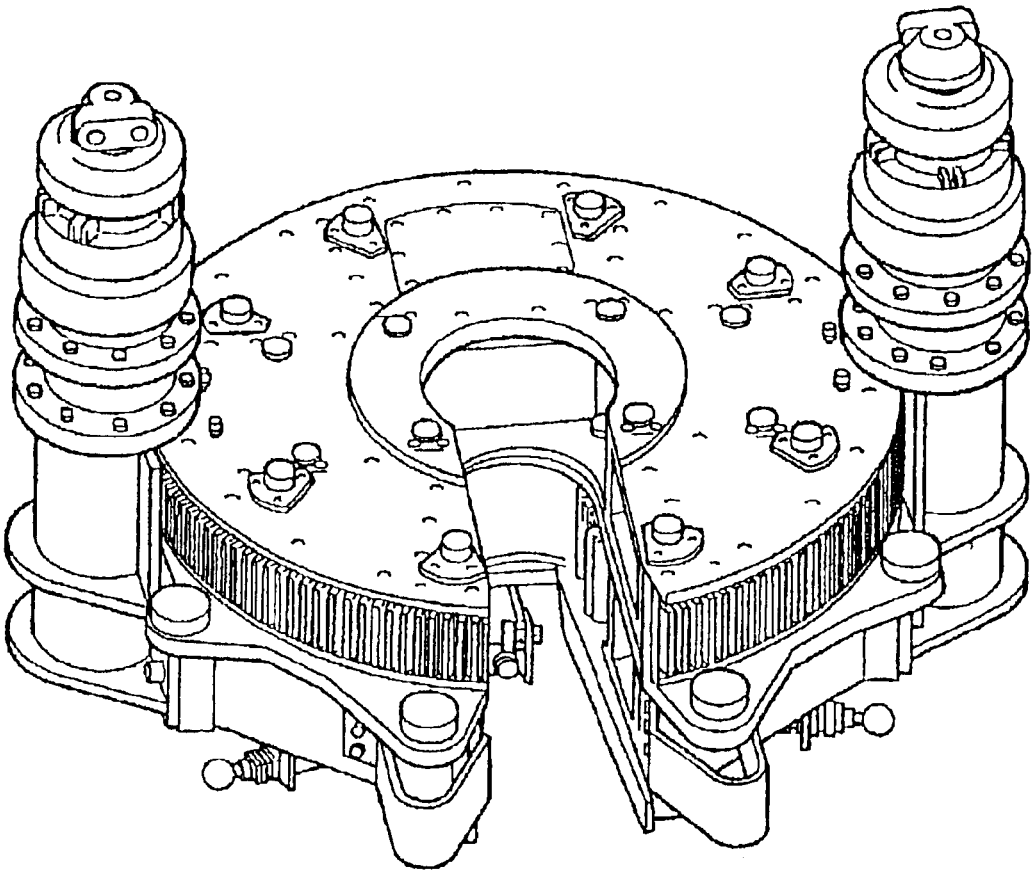
Figure 11:
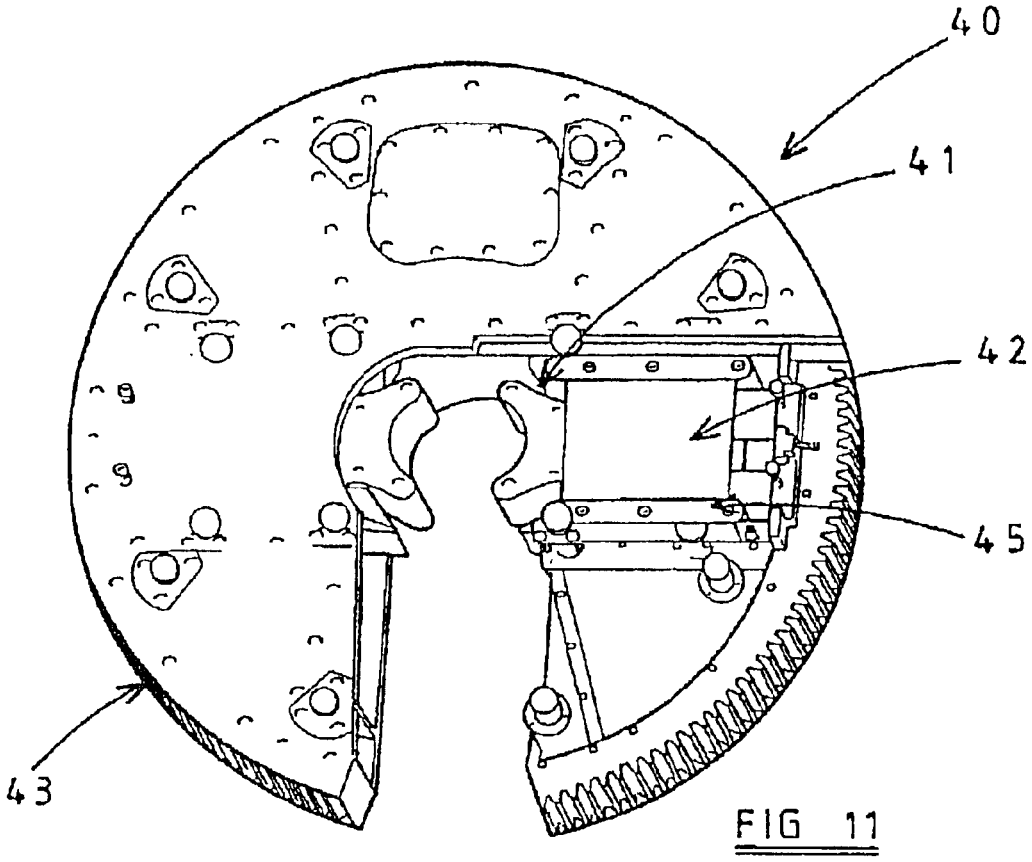
Figure 12:
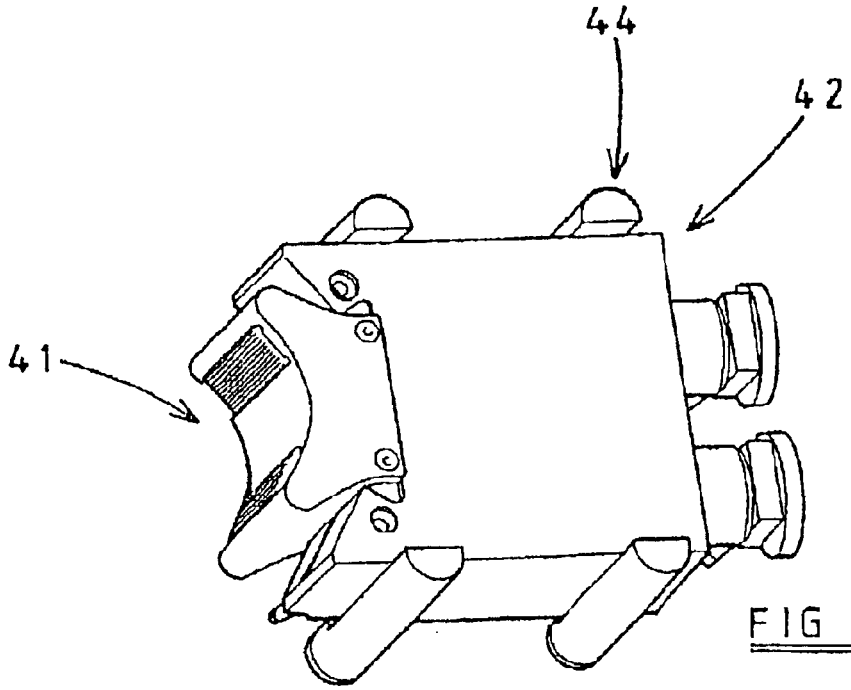
Figure 13:
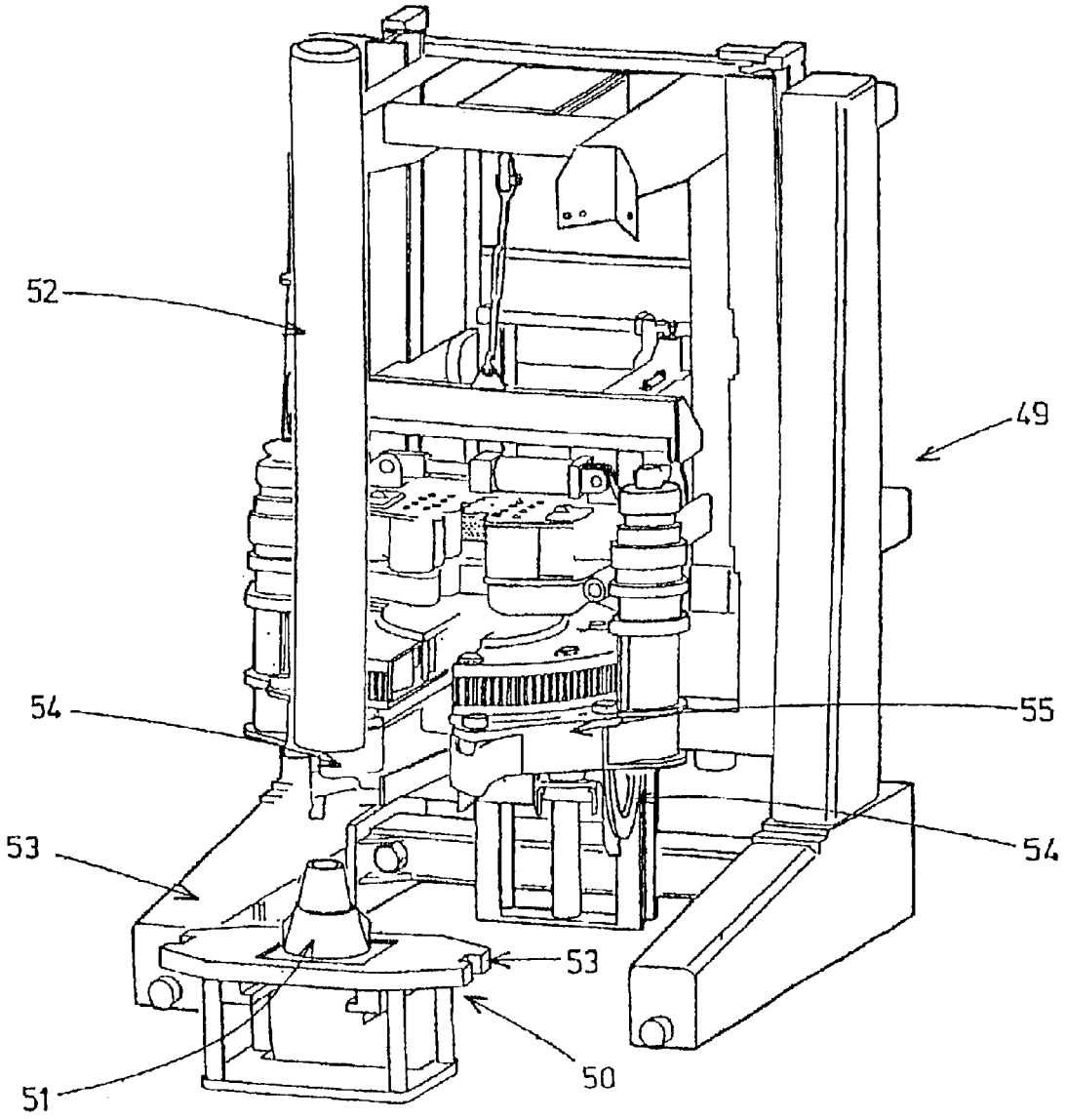
Figure 14:
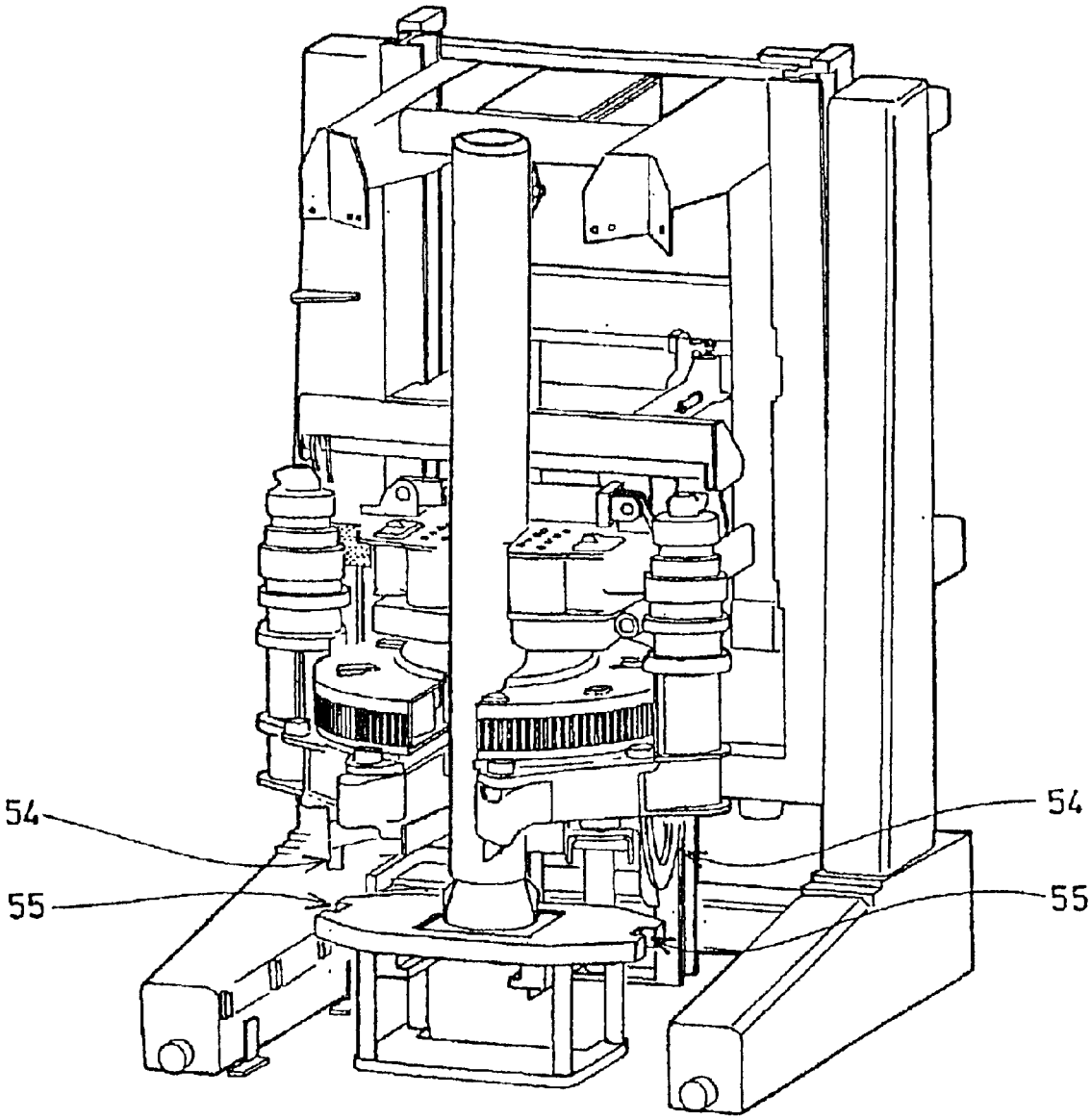
Figure 15:
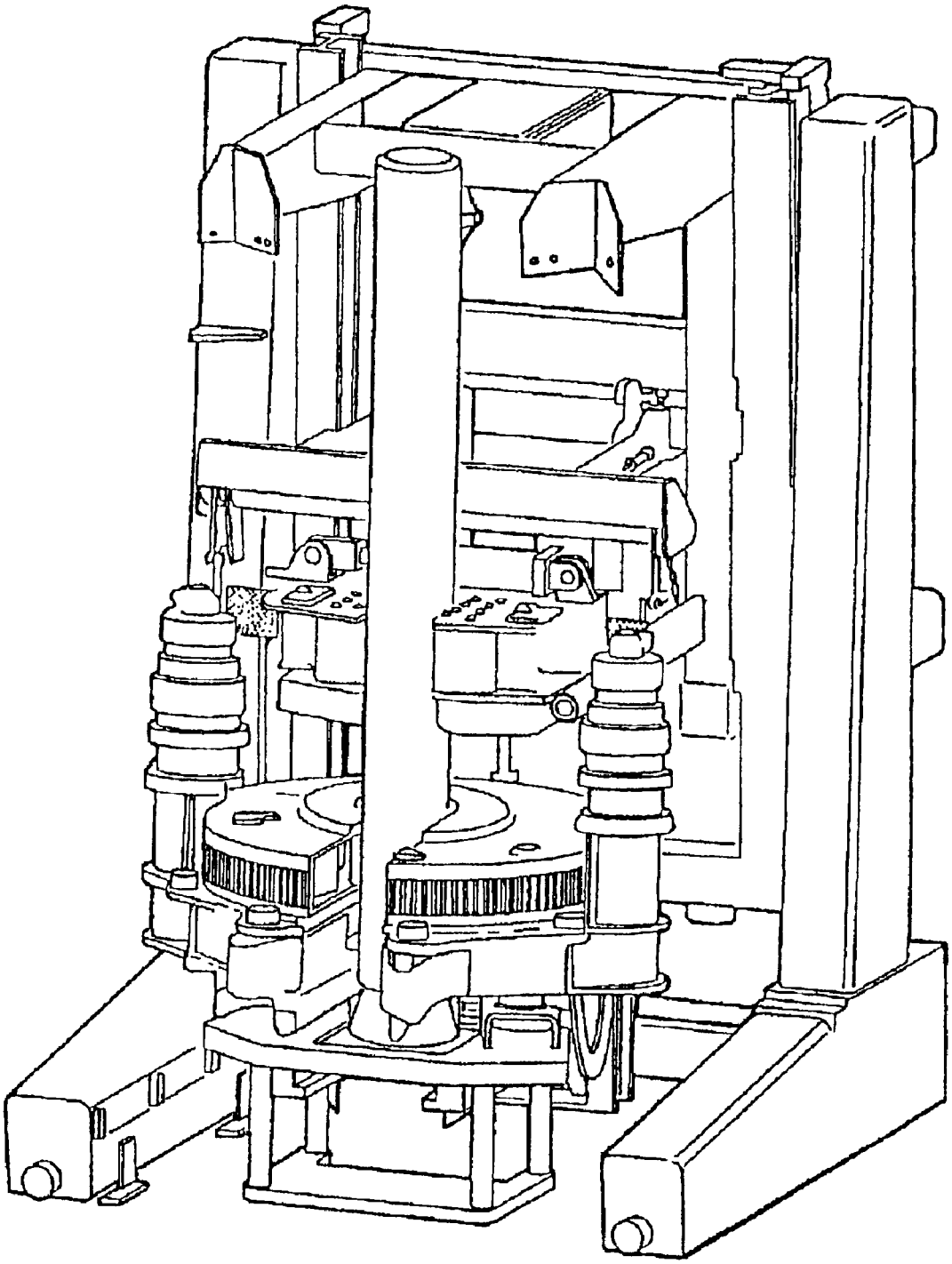

Some preferred embodiments of the invention will now be described by way of example only and with reference to the accompanying drawings, in which:

FIG. 1 is a view of an arrangement of a wrenching tong and a back-up tong;

FIG. 2 is a side view of the wrenching tong and back-up tong of FIG. 1;

FIG. 3 is a view of the back-up tong of FIG. 1;

FIG. 4 is a cutaway view of the back-up tong of FIG. 1;

FIG. 5 is a cutaway view of the wrenching tong of FIG. 1;

FIG. 6 is a view of the wrenching tong and back-up tong of FIG. 1 supported by a C-frame and fixed in a frame for handling equipment on tracks at a rig floor;

FIG. 7 is a view of the wrenching tong and back-up tong of FIG. 1 in use, with a tubular clamped in the wrenching tong;

FIG. 8 is a view of an arrangement of an alternative wrenching tong and back-up tong;

FIG. 9 is a view of an arrangement of a further alternative wrenching tong and back-up tong;

FIG. 10 illustrates a modified tong arrangement;

FIG. 11 illustrates a modified back-up tong;

FIG. 12 illustrates in detail a clamping arrangement of the tong of FIG. 11 including support elements;

FIG. 13 illustrates an arrangement for connecting a drill bit to a length of drill pipe;

FIG. 14 illustrates the arrangement of FIG. 13 during the connection operation; and FIG. 15 illustrates the arrangement of FIG. 13 following completion of the connection operation.

Figure 16:
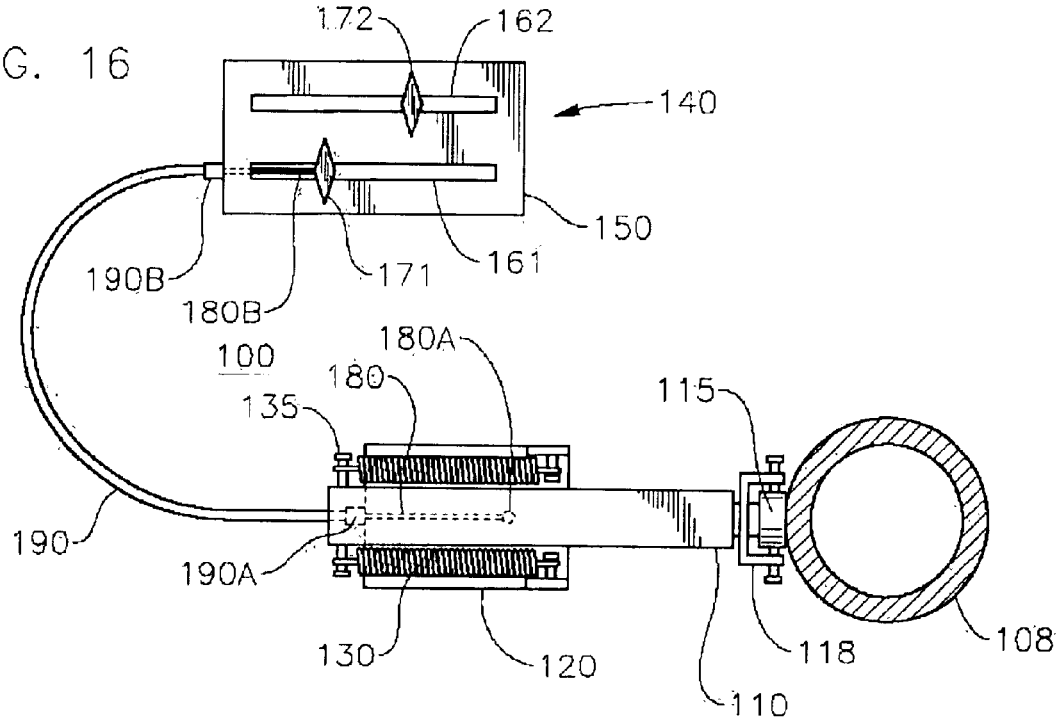

FIG. 16 is a schematic view of a positioning apparatus according to aspects of the present invention.

Figure 17:
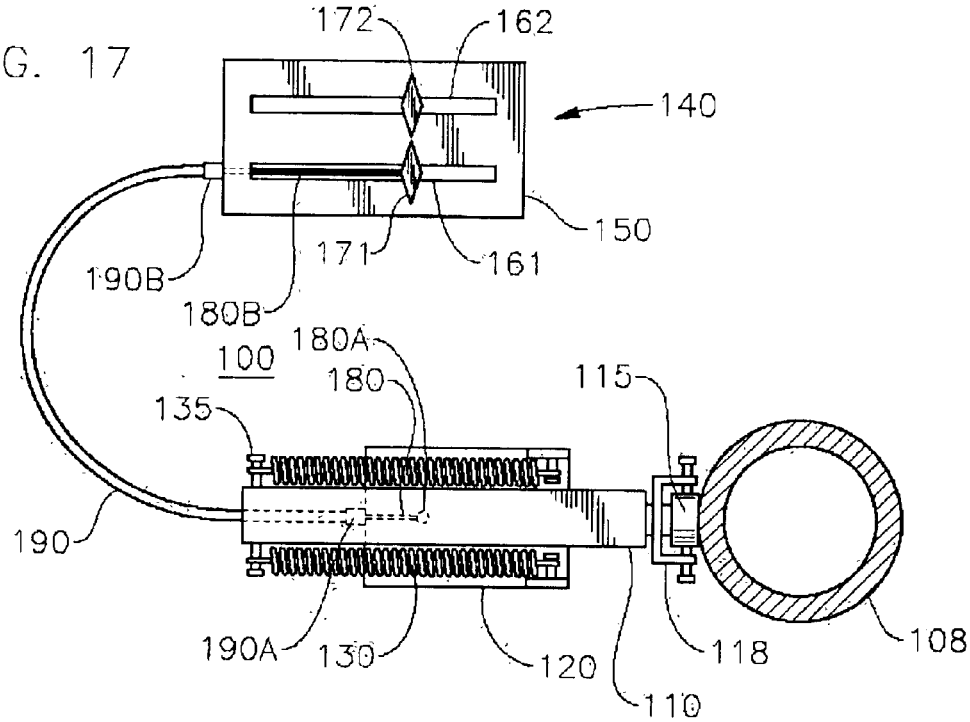

FIG. 17 is a schematic view of the positioning apparatus of FIG. 16 in an actuated position.

Figure 18:
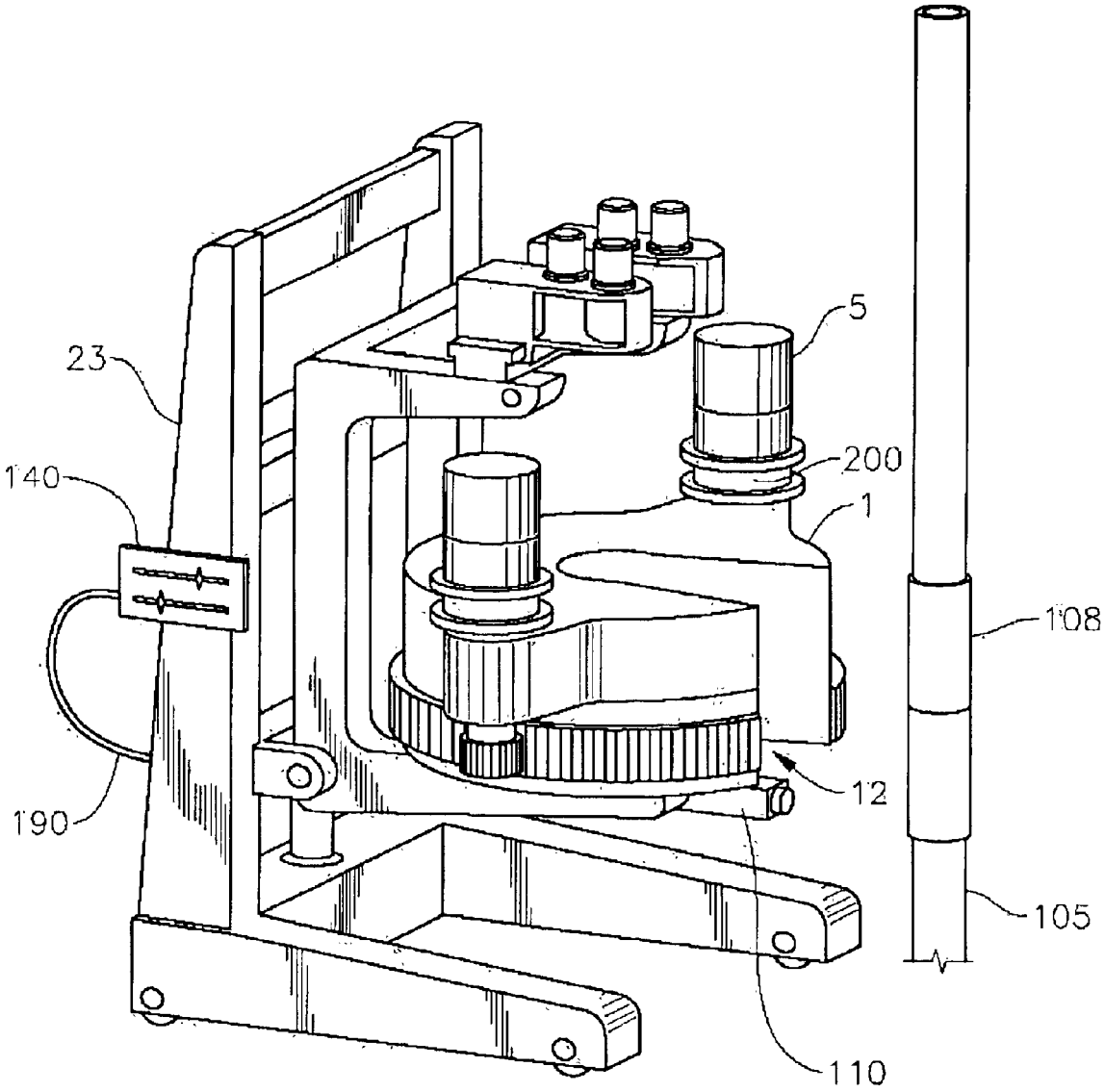

FIG. 18 illustrates the positioning apparatus of FIG. 16 mounted on the tong of the present invention.

Figure 19:
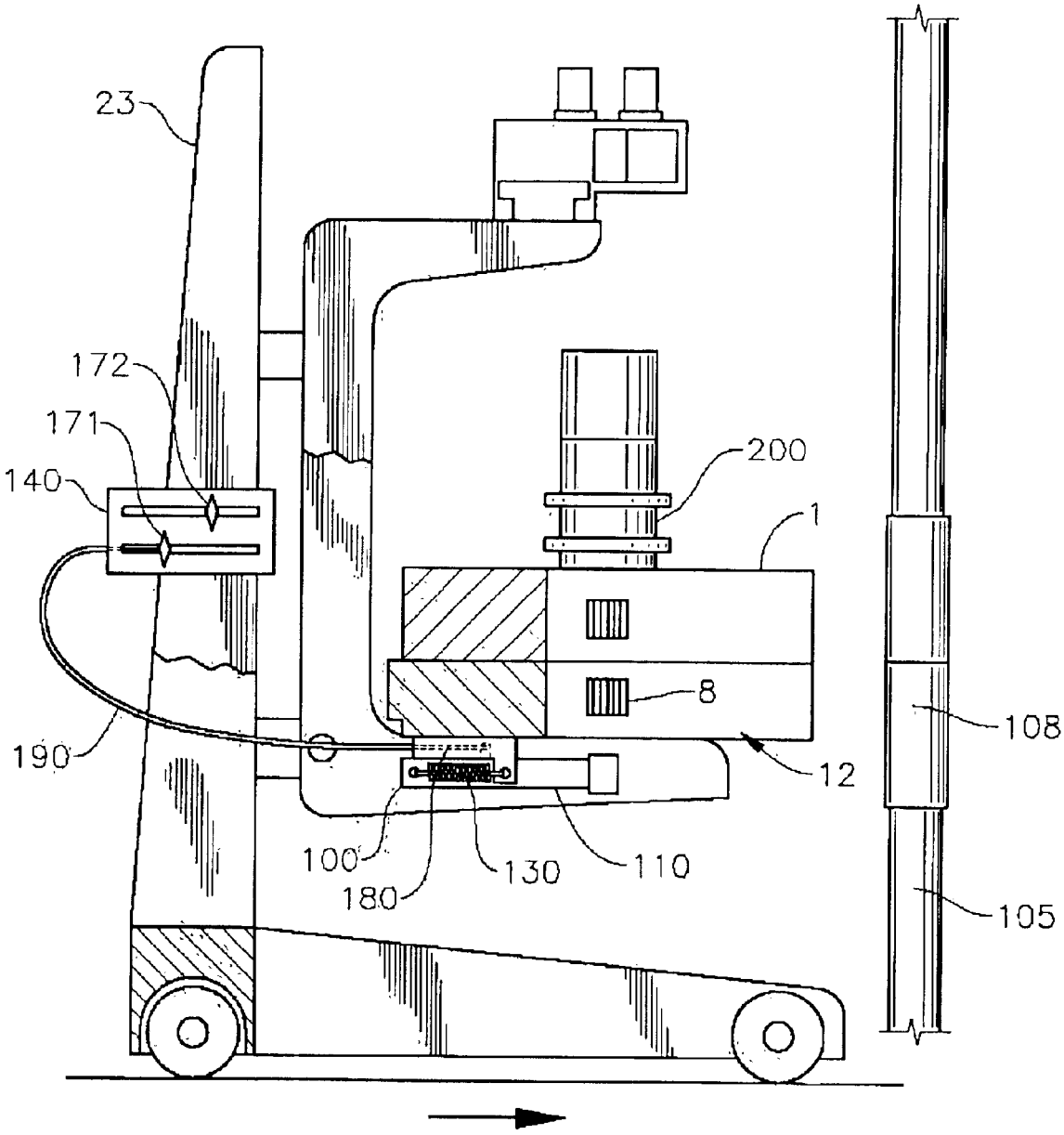

FIG. 19 is a schematic view of the positioning apparatus of FIG. 16 mounted on the tong of the present invention.

Figure 20:
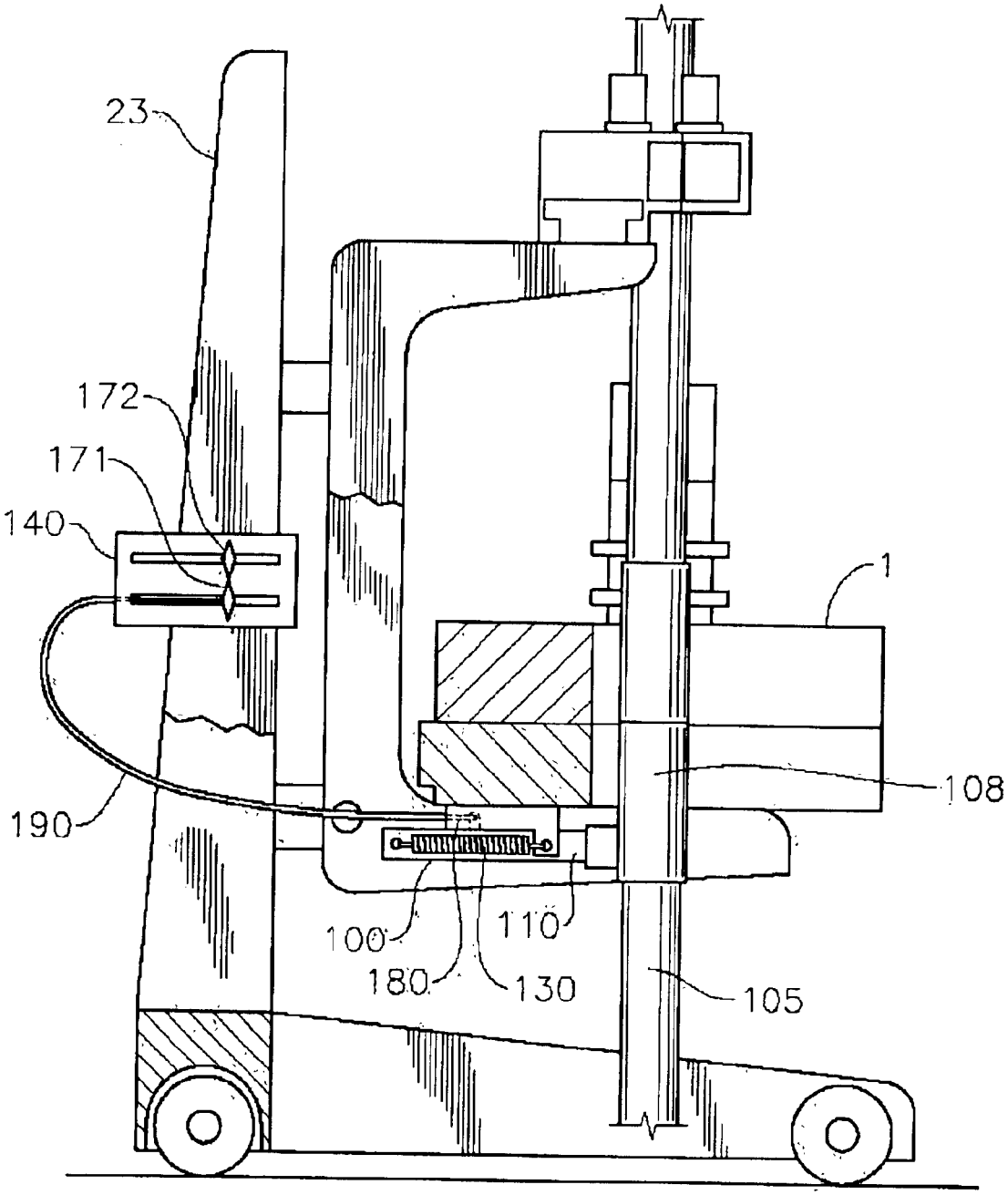

FIG. 20 is a schematic view of the positioning apparatus of FIG. 19 in an actuated position.

Figure 21:
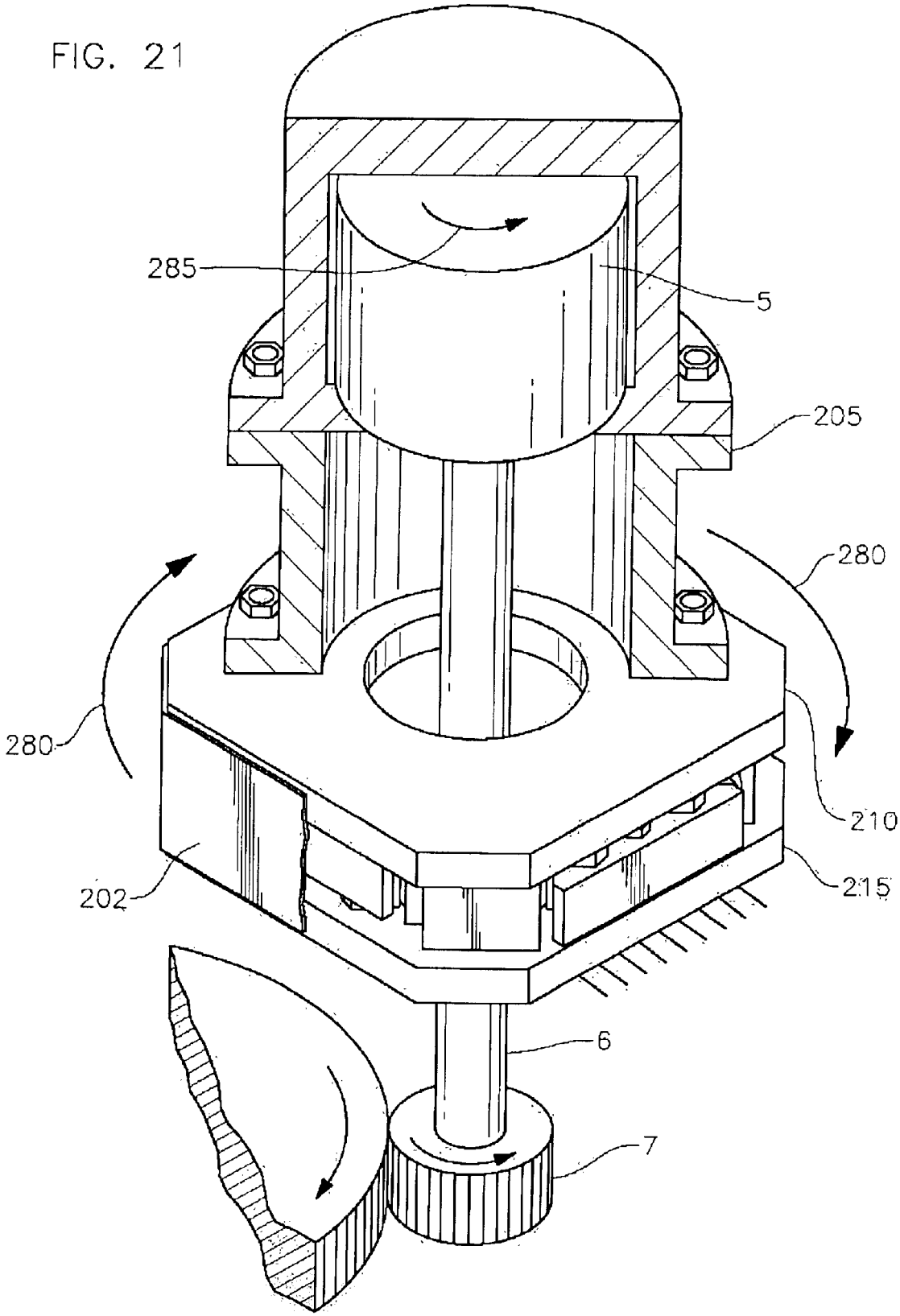

FIG. 21 is a schematic view of a torque measuring flange attached to a motor housing.

Figure 22:
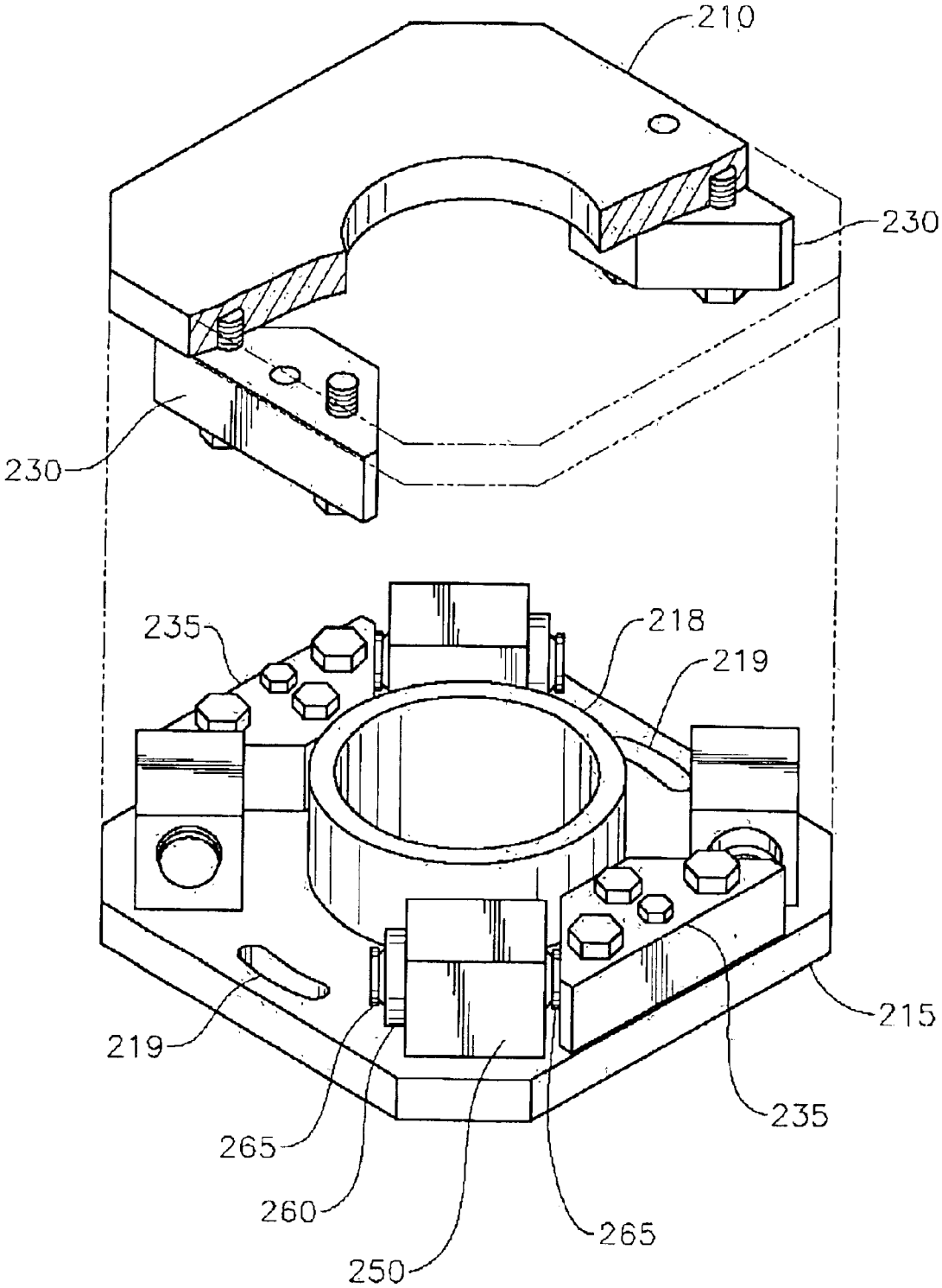

FIG. 22 is a schematic view of the torque measuring flange of FIG. 21.

Figure 23:
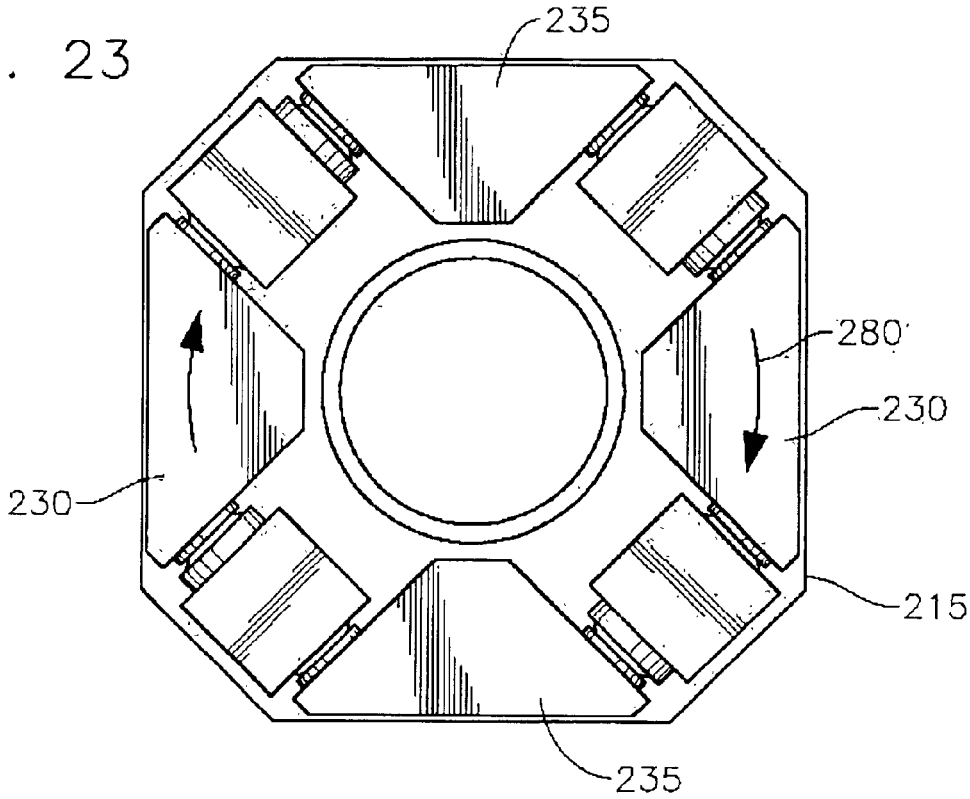

FIG. 23 is a schematic view of the torque measuring flange of FIG. 21 without the top plate.

Figure 24:
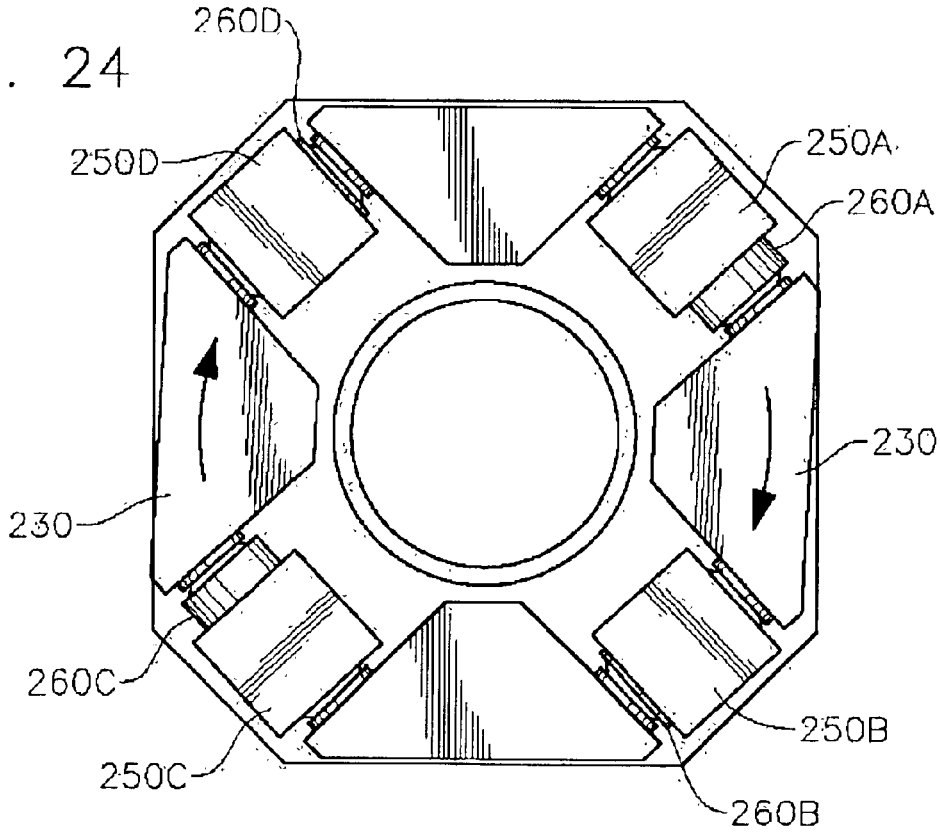

FIG. 24 is a schematic view of the torque measuring flange of FIG. 23 in an actuated position.

Figure 25:
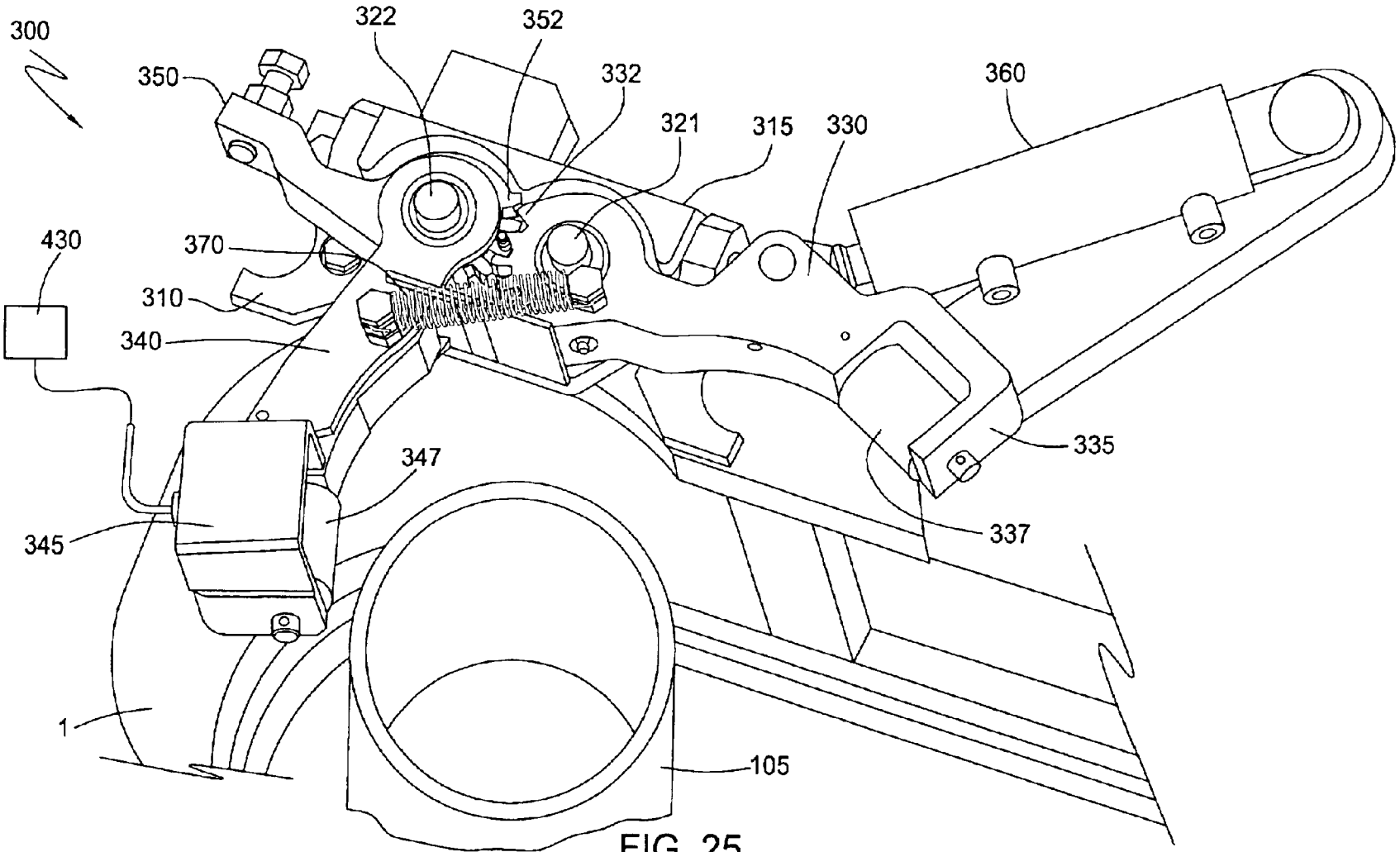

FIG. 25 is a schematic view of positioning tool from a perspective below the tong. In this view, the positioning tool is in the unactuated position.

Figure 26:
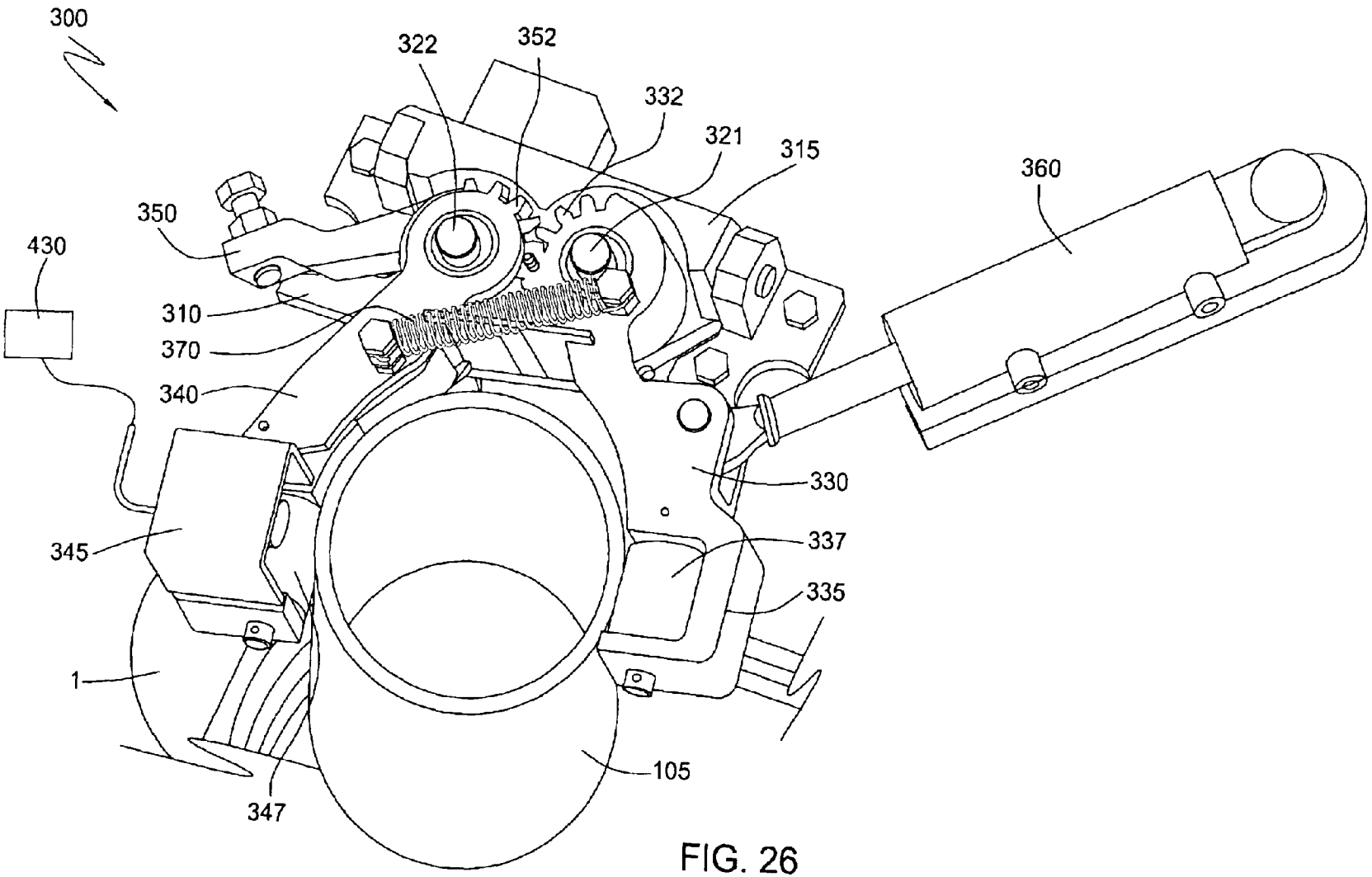

FIG. 26 is a schematic view of the positioning tool of FIG. 25 after the positioning tool has engaged the drill pipe.

Figure 27:
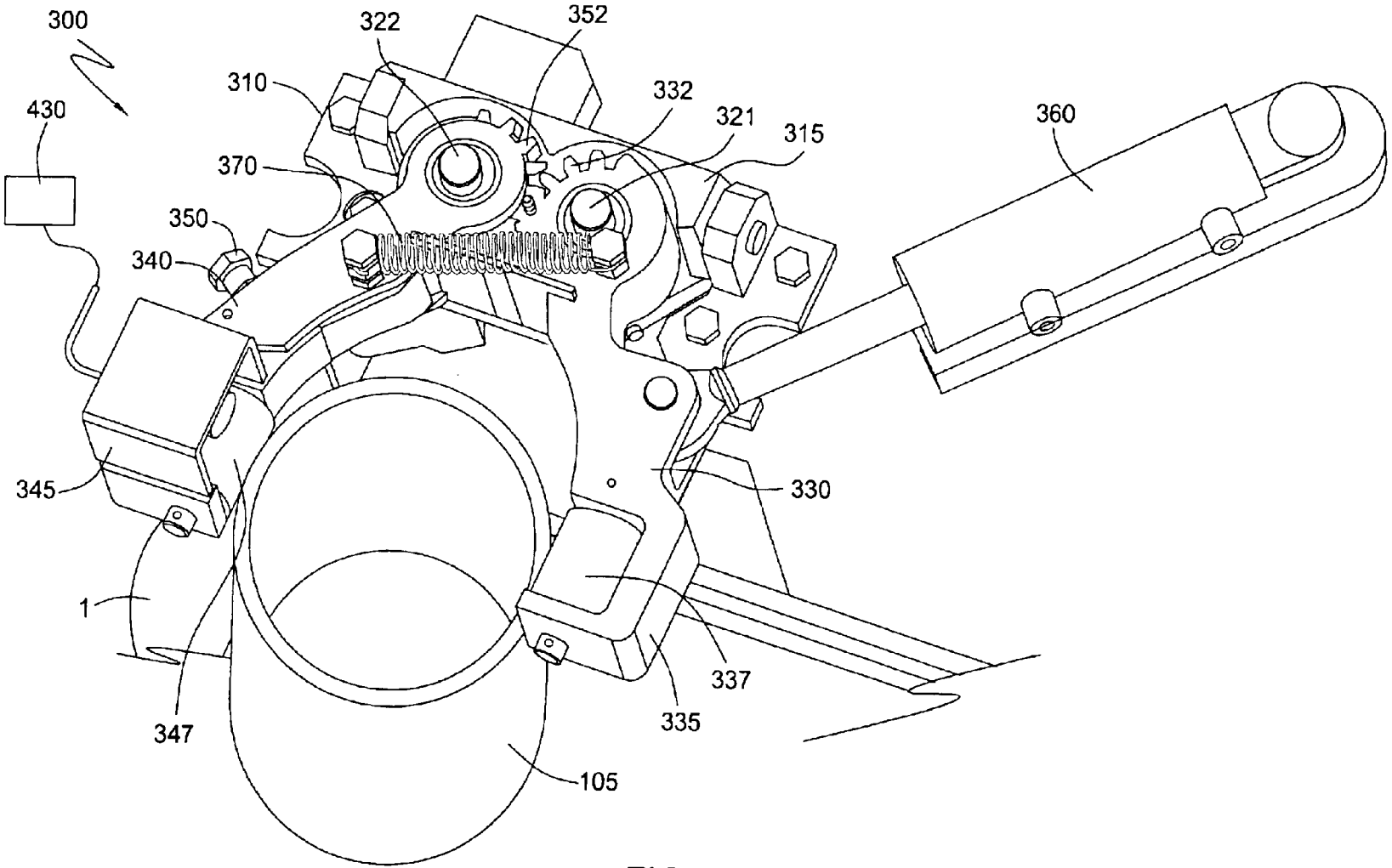

FIG. 27 is a schematic view of the positioning tool of FIG. 26 after the drill pipe has been centered.

Figure 28:
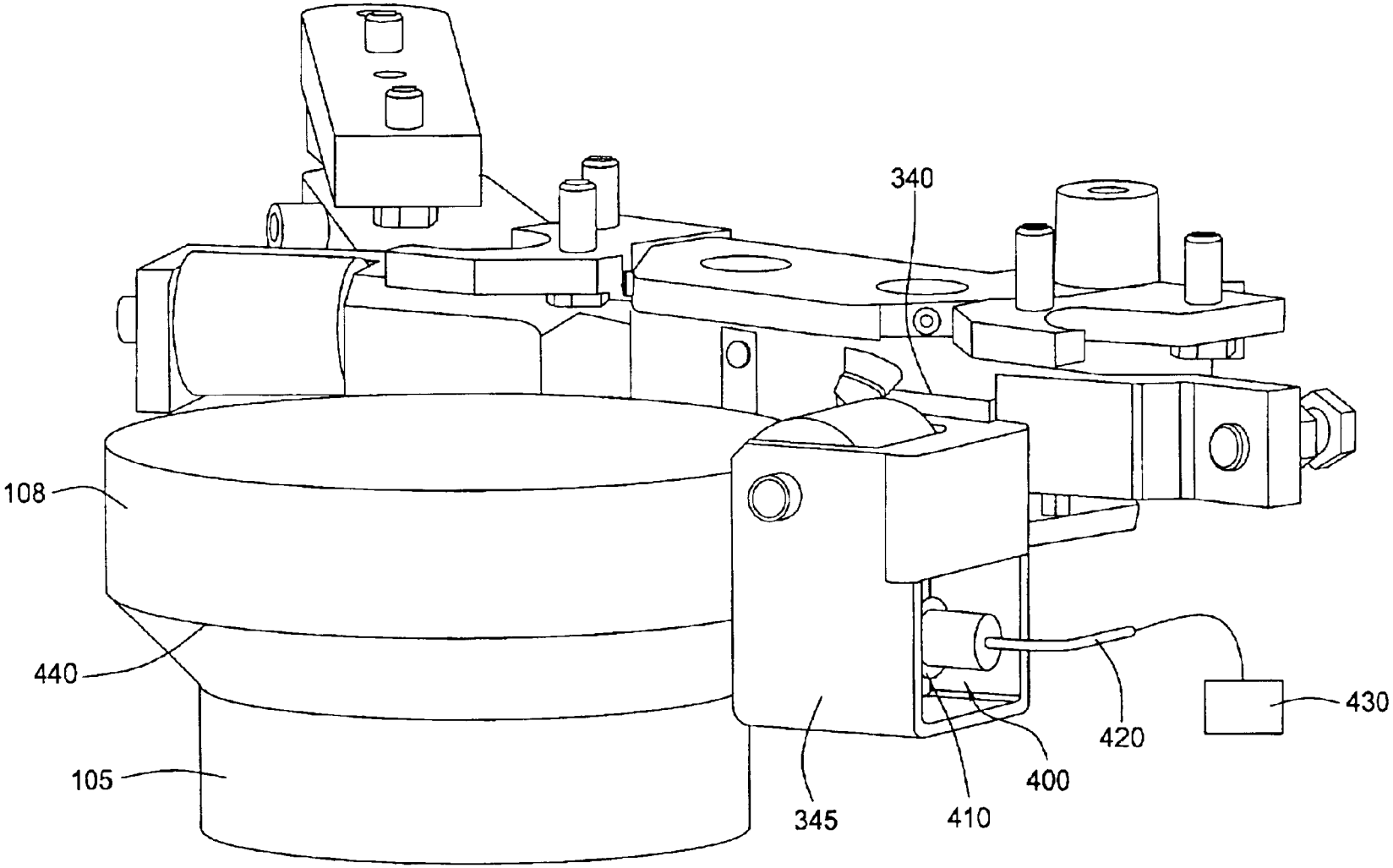

FIG. 28 is a schematic view of the positioning tool contacting the pipe joint of the drill pipe.

Figure 29:
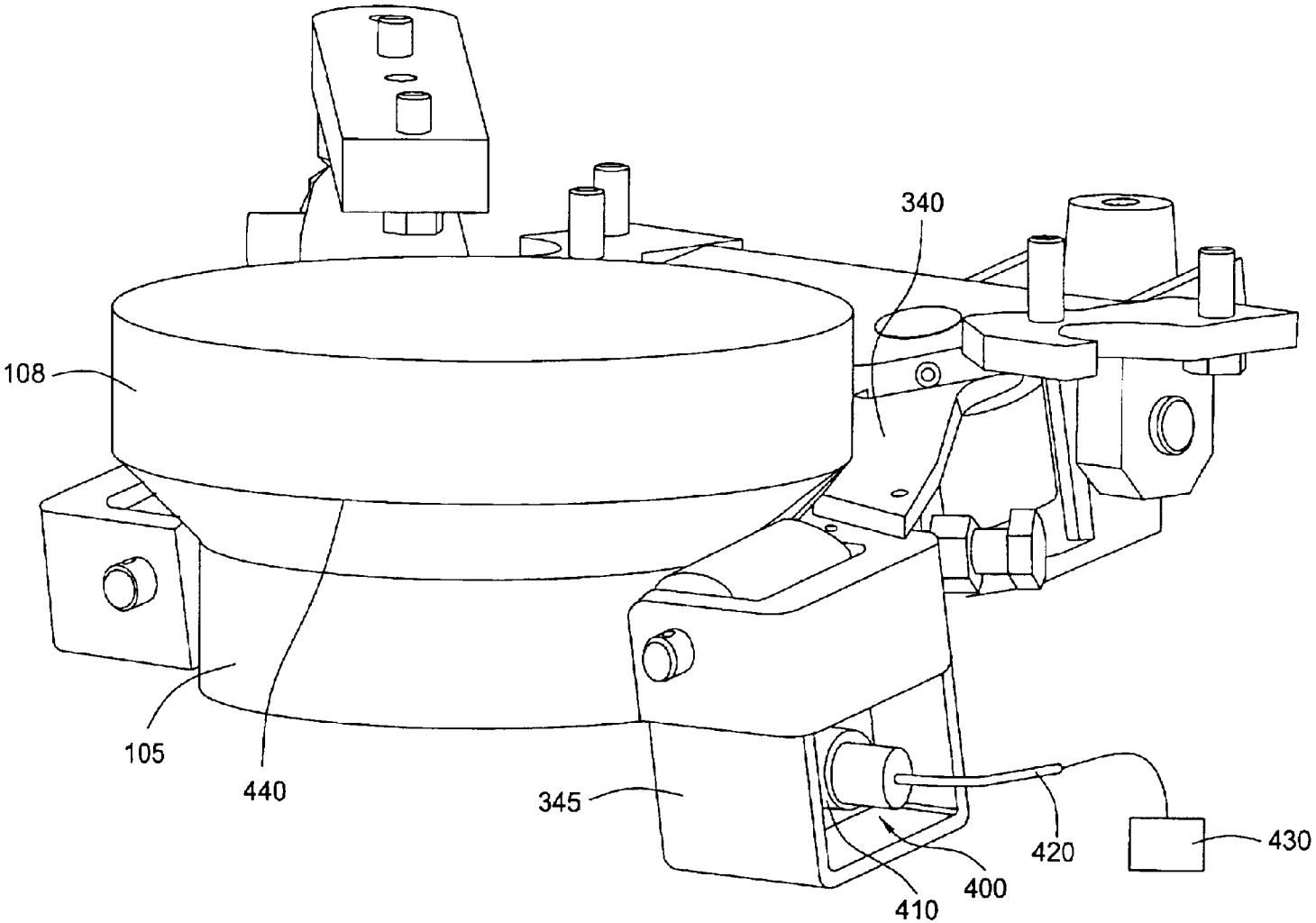

FIG. 29 is a schematic view of the positioning tool contacting the pipe body of the drill pipe.

DETAILED DESCRIPTION OF THE PREFERRED EMBODIMENT

FIGS. 1 and 2 show an arrangement of a composite wrenching tong and back-up tong. A wrenching tong 1 is generally in the form of a disc with an opening 2 through the center thereof for receiving a stand of drill pipe (not shown), and a recess 3 cut from the edge to the opening 2 at the center. The wrenching tong 1 is provided with two pinion drives 4 arranged opposite each other at the periphery of the disc, equally spaced either side of the recess 3. Each pinion drive comprises a drive motor 5, drive shaft 6, and pinion 7 attached to the drive shaft 6.

A back-up tong 11 is located beneath the wrenching tong 1. The back-up tong is generally in the form of a disc with similar dimensions to the wrenching tong 1. The back-up tong is also provided with an opening 12 through the center and a recess 13 from the edge to the opening at the center. The opening 12 and recess 13 correspond to the opening 2 and recess 3 of the wrenching tong when the backup tong 11 and the wrenching tong 1 are correctly aligned.

A plurality of guide rollers 10 or other guide elements are spaced around the edge of the wrenching tong 1 in order to maintain the alignment of the wrenching tong 1 with the back-up tong 11.

A gear 14 is provided around the periphery of the back-up tong 11, broken by the recess 13. The gear 14 meshes with the pinions 7 attached to the motors 5 on the wrenching tong, so that when the drive motors 5 drive the drive shafts 6 and gears 7, the wrenching tong 1 rotates relative to the back-up tong 11. The angle of rotation is limited by the recess 13 of the back up tong.

FIG. 3 shows a back-up tong 11 before the wrenching tong is placed on top of it. The back-up tong 11 has a plurality of roller bearings 21, upon which the wrenching tong 1 is designed to be placed. The roller bearings 21 are supported by resilient means such as springs, elastic material or hydraulic/pneumatic cylinders, in order to support the wrenching tong during wrenching. During one wrenching cycle, the stands will move axially relative to one another as the connection is tightened. The wrenching tong must follow the axial movement of the top stand during one wrenching cycle. This axial travel length depends on the pitch of the thread.

Three clamping jaws 8 equipped with dies 9 are located inside each of the wrenching tong 1 and back-up tong 11. These are hydraulically driven for clamping the drill pipe stand in place in the center of the wrenching tong. The hydraulic power supply may be provided by hoses (not shown).

FIG. 4 shows the clamping mechanism of the back-up tong 11. Three hydraulic pistons 16, comprising piston rods 17 and chambers 18, are located inside the casing of the back-up tong 11. Each piston rod 17 has an end 19 which is secured to the outside edge of the back-up tong 11. At the other end of the piston, the jaw 8 containing two dies 9 with teeth (not shown) is fixed to the chamber 18 by a spherical bearing 20. With the arrangement shown, each drill pipe stand is clamped by three jaws and six dies at the joint. The spherical bearings 20 enable the jaws and dies to match the pipe surfaces closely, resulting in a low penetration depth of the teeth of the dies into the pipe surface, and thus prolonging the life of the drill pipe. The wrenching tong has a similar clamping jaw design, as shown in FIG. 5.

FIG. 6 shows the wrenching tong 1 and back-up tong 11 supported by a C-frame 22 for handling at the rig. The C-frame 22 is in turn fixed in a frame 23 for handling the equipment on tracks at the rig floor. A drill pipe spinner 24 is mounted on the C-frame above the tongs for rotating a drill pipe stand at high speed.

In order to make a connection between two stands of drill pipe, the recesses 3 and 13 in the wrenching 1 and back-up 11 tongs are aligned (the tongs may already be in this configuration following the removal of the tongs from a previous section of tubing). Two stands of drill pipe 25, 26 are then introduced into the openings 2, 12 in the wrenching and back-up tongs 1, 11, respectively, through the recesses 3, 13, and the lower stand 26 is clamped in position in the back-up tong 11. The upper stand 25 is introduced into the drill pipe spinner 24, and rotated at high speed in order to pre-tighten the threaded connection. The final high torque will be applied by the wrenching tong 1.

The upper stand 25 is now clamped in position in the opening 2 through the wrenching tong 1. The pinion drives 4 are then driven to torque the connection between the stands 25, 26 until the connection is fully tightened or until one of the pinion drives 4 is at the edge of the recess 13, at which stage the wrenching tong 1 is at one end of its possible arc of travel relative to the back-up tong 11. The maximum wrenching angle which can be reached in one cycle in the embodiment shown is +/−75°. If necessary, the upper stand 25 can then be released from the wrenching tong 1, the tong returned to its original position, and the torquing process repeated.

To break a connection, the above operation is reversed.

An even larger wrenching angle can also be simply achieved with this arrangement, as shown in FIG. 7. The stands of drill pipe 25, 26 are introduced to the tongs 1, 11 through the recesses 3, 13 and pretightened using the drill pipe spinner 24 as described above. However, before the top stand 25 is clamped in place in the opening 2, the wrenching tong drive is reversed, and the wrenching tong 1 is driven to its end position relative to the back-up tong, as shown in FIG. 7. The top stand 25 is now clamped with the tongs in this position, so that with the embodiment shown a wrenching angle of 150° is achievable.

FIG. 8 shows a similar arrangement of a composite wrenching tong and back-up tong to that described above. However, in this case only one pinion drive 4 is used, which increases the possible wrenching angle to 300°.

FIG. 9 shows another similar arrangement, with two pinion drives 4 being used as in FIGS. 1 to 7. This time the pinion drives 4 are not opposite each other, but spaced 120° each side of the recess 3. This gives the advantage of the torque and control provided by two drives, but allows a higher wrenching angle than the arrangement of FIG. 1. The maximum wrenching angle in this embodiment will be in the region of 210°.

The torque can be monitored by measuring the reaction torque at each drive by means of a load cell, or by measuring the pressure of the drive motor.

It is to be understood that other variations are possible while still falling within the scope of the invention. For example, the preferred embodiments show an arrangement whereby the pinion drives are mounted on the wrenching tong and the gear is mounted on the back-up tong. However, the arrangement could be the other way round with the pinion drives mounted to the back-up tong and the large gear mounted on the wrenching tong. Such an arrangement is illustrated in FIG. 10.

Alternatively, the wrenching tong could be provided with a gear, and the pinion drives mounted on the frame 24.

Hydraulic clamping cylinders are shown, but the tong could clamp the drill pipe stands by any known means.

The preferred embodiments show one or two pinion drives, but more could be used if arranged in a suitable configuration.

Although the preferred embodiments have been described in relation to tightening stands of drill pipe, it is to be understood that the arrangements described are suitable for applying torque to any tubular sections.

FIG. 11 illustrates in partial section a modified back-up tong 40 which may replace the back-up tong 11 of the embodiment of FIGS. 1 to 9. The modified tong 40 has only two jaws 41 associated with respective clamping arrangements 42. Each arrangement 42 is held in place within the main body 43 of the tong 40 by a set of four "pendulum" bolts 44. A clamping arrangement 42 associated with four pendulum bolts 44 is illustrated in more detail in FIG. 12 from which it can be seen that each bolt comprises a cylinder cut in half along its longitudinal axis to provide a flat surface and a rounded surface. The flat surface of each bolt 44 abuts the side of the clamping arrangement 42, whilst the rounded side is located in a rounded recess 45 provided in the side of the main body 43 opposed to the clamping arrangement. It will be appreciated that as the bolts 44 are able to rotate within their respective recesses in the tong body 43, each clamping arrangement 42 may pivot slightly about its center. This allows the jaws 41 to conform to the outer surface of a tubular to be clamped when the tubular is for example not perfectly cylindrical.

FIG. 13 illustrates apparatus which can be used in association with a tong arrangement 49 to connect and disconnect a tool such as a drill bit to and from a length of tubular such as a drill pipe. The apparatus comprises a basket 50 which is arranged in use to be placed on the floor of a drilling rig. The basket 50 has an opening in the top thereof for receiving a tool 51 which is to be connected to a length of tubular 52. The opening has a shape which is complimentary to the shape of the tool 51 such that the tool is held securely in an upright position and rotation of the tool within the basket 50 is prevented.

Two opposed sides of an upper plate of the basket 50 are provided with slots 53. These slots 53 are shaped to receive locking members 54 which project downwardly from the lower surface of the back-up tong 55 of the tong arrangement. The operation to connect a tool will now be described.

As shown in FIG. 13, the tool 51 is first located in the basket 50. The length of tubular 52 is moved to a position over the tool (FIG. 14) and is lowered to bring the box of the tubular into engagement with the externally threaded coupling of the tool 51. At this point, the tong arrangement is brought up to the tubular 52 with the jaws of the rotary and back-up tongs being fully opened, and the tong is placed around the tubular 52. The tong arrangement is then lowered within its frame, to a position in which the locking members 54 are received by the respective receiving slots 53 of the basket 50. In this position, the basket is locked to the back-up tong. The jaws of the rotary tong are then clamped against the tubular 52 and the rotary tong rotated, relative to the back-up tong, to tighten the threaded joint (FIG. 15). The jaws of the rotary tong are then released, and the tong arrangement withdrawn from around the tubular. The tubular and the connected tool can then be lifted clear of the basket 50.

It will be appreciated that the tool 51 may be disconnected from the tubular 52 by carrying out the same operation but in reverse.

FIG. 16 illustrates a positioning apparatus 100 which may be used in association with the tong 1 of the present invention. Typically, the positioning apparatus 100 is mounted onto a lower portion of the tong 1 as shown in FIGS. 18 and 19. The tong 1, in turn, is disposed on a movable frame 23. In one aspect, the positioning apparatus 100 may be used to position the drill pipe 105 in the center of the tong 1. Placing the drill pipe 105 in the center position reduces the possibility that the jaws 8 of the tong 1 will damage the drill pipe 105 when the tong 1 is actuated.

The positioning apparatus 100 includes a plunger 110 slidably disposed on a base 120 as illustrated in FIG. 16. The base 120 may include one or more guides (not shown) defining a track for the plunger 110 to traverse. The plunger 110 is positioned such that it may contact the drill pipe 105 as it enters an opening 12 in the tong 1. A contact member 115 is disposed at a contact end of the plunger 110. A contact support 118 may be used to alleviate the contact force endured by the contact member 115.

One or more biasing members 130 are used to couple the plunger 110 to the base 120. The biasing members 130 are used to maintain the plunger 110 in an initial position as seen in FIG. 16. Preferably, two springs 130 are used to couple the plunger 110 to the base 120. Specifically, one end of the spring 130 is attached to the base 120 and the other end of the spring 130 is attached to the plunger 110. The springs 130 may be attached to the plunger 110 by latching onto a rod 135 extending across the plunger 110.

The positioning apparatus 100 further includes a visual locator 140. In one embodiment, the visual locator 140 may include a housing 150 having two elongated slots 161, 162. Preferably, the elongated slots 161, 162 are substantially parallel to each other. A first indicator 171 and a second indicator 172 are movably coupled to a first elongated slot 161 and a second elongated slot 162, respectively. The first indicator 171 may be coupled to the plunger 110 using a cable 180, whereby one end 180A of the cable 180 is attached to the plunger 110 and the other end 180B attached to the first indicator 171. The cable 180 is movable within a sleeve 190 having one end 190A attached to the base 120 and the other end 190B attached to the visual indicator 140. In this manner, movement in the plunger 110 may cause the first indicator 171 to travel the same distance along the first elongated slot 161.

The second indicator 172 may be set at a predetermined position on the second elongated slot 162. The predetermined position correlates to the desired position of the drill pipe 105 relative to the tong 1. Generally, the tong 1 will grip the pipe joint 108 instead of the drill pipe 105 during the connection process. Therefore, the diameter of the pipe joint 108 will generally be used to determine the proper location of the drill pipe 105. Because the second indicator 172 is movable, the positioning apparatus 100 is useable with the tong 1 to position drill pipes 105 of various size.

In operation, the positioning apparatus 100 is mounted onto the tong 1 with the plunger 110 protruding towards the opening 12 in the tong 1 as illustrated in FIGS. 18 and 19. As shown, the plunger 110 is in the initial position and the springs 130 are unactuated.

As the frame 23 moves the tong 1 towards the drill pipe 105, the plunger 110 contacts the drill pipe 105 before the drill pipe 105 reaches the center of the jaws 8. Thereafter, the plunger 110 is pushed away from the tong 1 as the tong 1 continues to move closer to the drill pipe 105 as illustrated in FIGS. 17 and 20. Specifically, the plunger 110 slides along the base 120 as the tong 1 moves closer, thereby extending the springs 130. At the same time, the end 180A of the cable 180 attached to the plunger 110 is pushed into the sleeve 190, thereby causing the end 180B of the cable 180 attached to the first indicator 171 to extend further from the sleeve 190. In this manner, the first indicator 171 is moved along the first elongated slot 161.

The drill pipe 105 is properly positioned when the first indicator 171 reaches the level of the second indicator 172 as seen in FIGS. 17 and 20. Thereafter, an operator observing the visual indicator 140 may stop the tong 1 from moving further. After the connection process is completed, the frame 23 is moved away from the drill pipe 105. The biasing members 130 bring the plunger 110 back to the initial position, thereby causing the first indicator 171 to move away from the second indicator 172.

According to another aspect, the movement of the tong 1 may be automated. In one embodiment, the visual locator 140 may further include a first sensor (not shown) to indicate that the first indicator 171 is proximate the second indicator 172. The first sensor is triggered when the first indicator 171 is next to the second indicator 172. This, in turn, sends a signal to a programmable controller (not shown) to stop the advancement of the tong 1. In another embodiment, a second sensor (not shown) may be used to indicate that the first indicator 171 has moved past the second indicator 172. If the first indicator 171 moves past the second indicator 172, the second sensor may send a signal to the programmable controller to prevent the tong 1 from actuating and back-up the tong 1 until the proper position is attained.

FIG. 18 illustrates a torque measuring flange 200 which may be used in association with the tong 1 of the present invention. In one aspect, the flange 200 may be used to measure the torque applied to makeup or breakup the drill pipe 105. Drill pipe connections are generally designed to makeup or breakup at a specific torque. If insufficient torque is applied, the connection may not conform to the requisite specifications for use downhole. On the other hand, if too much torque is applied, the connection may be damaged. As discussed above, the torque applied to the tong 1 can be monitored by measuring the pressure of the drive motor 5. Thus, a torque measuring flange 200 is useful in monitoring and controlling the torque applied to the drill pipe connection.

According to aspects of the present invention, the flange 200 may include a top plate 210 and a bottom plate 215 as illustrated in FIG. 21. The top plate 210 may be connected to the motor housing 205 and the bottom plate 215 may be connected to the gear housing (not shown). A splash guard 202 may be used to enclose the flange 200. Referring to FIG. 22, the bottom plate 215 has a tubular portion 218 disposed in the center for housing the shaft 6 which couples the motor 5 to the gear 7. The tubular portion 218 also prevents debris or grease from the shaft 6 from entering the interior of the flange 200. The plates 210, 215 may be connected to each other using one or more bolts (not shown). Preferably, elongated slots 219 are formed on the bottom plate 215 for connection with the bolts. As will be discussed below, the elongated slots 219 allow the plates 210, 215 to rotate relative to each other during operation.

One or more wedges 230, 235 may be disposed inside the flange 200. Preferably, two wedges 230 are attached to the top plate 210 and two wedges 235 are attached to the bottom plate 215. The wedges 230, 235 on each plate 210, 215 are disposed at opposite sides of the plate 210, 215, whereby the base of the wedge 230, 235 is substantially parallel to one side of the plate 210, 215. The plates 210, 215 are brought together in a way that the four wedges 230, 235 are equally spaced apart in the flange 200.

The flange 200 may further include one or more torque measuring cylinders 250. As shown in FIG. 8, each cylinder 250 is placed between two wedges 230, 235. Preferably, the cylinders 250 are freely movable within the flange 200. In one embodiment, the cylinders 250 are fluid containing chambers having a piston 260 at least partially disposed within the chamber. The piston 260 may further include an axial spherical bearing 265 disposed at an outer end of the piston 260 for auto-alignment with the wedges 230, 235. When the piston 260 contacts a wedge 230, 235, the bearing 265 may pivot against the contact surface thereby achieving maximum contact with the wedge 230, 235. Bearings 265 may also be placed on the end of the cylinder 250 opposite the piston 260.

As indicated earlier, the cylinders 250 are capable of indicating the torque applied by the motor 5. In one embodiment, each cylinder 250 may include a pressure transducer (not shown) for determining the torque applied. The pressure transducer may convert the fluid pressure in the fluid chamber into electrical signals that can be sent to a programmable logic controller (not shown) as is known to a person of ordinary skill in the art. The controller may be programmed to operate the tong 1 based on the signals received. Alternatively, a pressure line may be use to connect the cylinder 250 to a pressure operated gauge. The gauge can be calibrated to read the pressure in the cylinder 250. In this manner, any pressure change in the cylinder 250 can be monitored by the gauge.

In operation, the flange 200 is disposed between the motor housing 205 and the gear housing. Specifically, top plate 210 is attached to the motor housing 205 and the bottom plate 215 attached to the gear housing. When the motor is actuated, the motor housing 205 experiences a torque 280 in the opposite direction of the torque 285 applied by the motor 5 as illustrated in FIG. 21. The housing torque 280 is translated from the motor housing 205 to the top plate 210. As discussed above, the top plate 210 is bolted to the bottom plate 215 through the elongated slot 219 in the bottom plate 215. The elongated slot 219 allows the top plate 210 to move relative to the bottom plate 215 when torque is applied. The relative rotation causes the wedges 230, 235 to compress against the cylinders 250. This, in turn, compresses the piston 260, thereby increasing the fluid pressure in the cylinder chamber.

FIG. 23 illustrates a top view of the flange 200 with the top plate 210 removed. The flange 200 is shown before any torque is translated to the top plate 210. FIG. 24 illustrates a top view of the flange 200 after the torque is translated to the top plate 210. It can be seen the wedges 230 attached to the top plate 210 have been slightly rotated in relation to the wedges 235 on the bottom plate 215. This rotation compresses cylinders 250B and 250D between the wedges 230, 235, thereby compressing the piston 260 in the cylinders 250B, 250D. However, pistons 260 of cylinders 250A, 250C are not compressed because the wedges 230 have been rotated away from the cylinders 250A, 250C. Instead, the pistons 260 are allowed to extend from the cylinders 250A, 250C. It is appreciated that the aspects of the present invention are equally applicable when the motor 5 rotates in the opposite direction.

If a pressure transducer is used, the pressure in the cylinder 250 can be converted to an electric signal that is sent to a programmable controller. In this manner, the torque applied by the motor 5 can be controlled and monitored by the controller. Alternatively, if a pressure gauge is used, the change in pressure may be observed by an operator. The operator can then operate the tong 1 according to the pressure readings.

FIG. 25 illustrates a positioning tool 300 which may be used in association with the tong 1 of the present invention. Typically, the positioning tool 300 is mounted onto a lower portion of the tong 1 as shown in FIG. 25. The tong 1, in turn, is disposed on a movable powerframe (not shown). In one aspect, the positioning tool 300 may be used to position the drill pipe 105 in the center of the tong 1. Placing the drill pipe 105 in the center position reduces the possibility that a gripping apparatus of the tong 1 will damage the drill pipe 105 when the tong 1 is actuated. Examples of the gripping apparatus include jaws and slips.

The positioning tool 300 includes a base 310 for mounting the positioning tool 300 on the tong 1. A body portion 315 of the base 310 houses a first axle 321 and a second axle 322. A centering member 330 is movably connected to the first axle 321, and a positioning member 340 and a support member 350 are movably connected to the second axle 322. The positioning tool 300 may further include actuating means 360 for moving the centering member 330 between an open position and a closed position. Preferably, the actuating means 360 is a piston and cylinder assembly 360.

The proximal end of the centering member 330 has a gear 332 that is coupled to a gear 352 of the support member 350. The gears 332, 352 allow the support member 350 to move in tandem with the centering member 330 when the centering member 330 is moved by the piston and cylinder assembly 360. For example, when the piston and cylinder assembly 360 moves the centering member 330 to an unactuated position as illustrated in FIG. 25, the gears 332, 352 will cause the support member 350 to also move to the open position. Upon actuation, the piston 360 extends from the assembly 360, thereby causing the centering member 330 and the support member 350 to rotate toward each other. A housing 335 is disposed at the distal end of the centering member 330 for maintaining at least one gripping means 337. Preferably, the gripping means 337 is a roller 337 so that it may facilitate vertical movement of the drill pipe 105.

The proximal end of the positioning member 340 is movably connected to the second axle 322. A biasing member 370 couples the positioning member 340 to the centering member 330. In the preferred embodiment shown in FIG. 25, a spring 370 is used as the biasing member 370. When the centering member 330 is moved away from the positioning member 340, the tension in the biasing member 370 causes the positioning member 340 to move in a manner that will reduce the tension in the biasing member 370. It must be noted that even though the positioning member 340 is connected to the second axle 322, the positioning member 340, unlike the support member 350, is capable of independent movement from the gears 332, 352. A housing 345 is disposed at the distal end for maintaining at least one gripping means 347. Preferably, the gripping means 347 comprise a roller 347. In one embodiment, the gripping means 347 of the positioning member 340 is positioned in the path of the drill pipe 105 as the drill pipe 105 enters the opening of the tong 1. As the tong 1 moves toward the drill pipe 105, the positioning member 340 contacts the drill pipe 105 and is caused to move to a predetermined position as shown in FIG. 26. In this position, the movement of the tong 1 is temporarily stopped and the centering member 330 is moved into contact with the drill pipe 105. In another embodiment (not shown), the positioning member 340 may be preset at the predetermined position. After the drill pipe 105 enters the opening and contacts the gripping means of the positioning member 340, the movement of the tong 1 is immediately stopped and the centering member 330 moved into contact with the drill pipe 105.

As discussed above, the support member 350 is connected to the second axle 322 and includes a gear 352 coupled to the gear 332 of the centering member 330. Thus, the movement of the support member 350 is controlled by the movement of the centering member 330. The design of the support member 350 is such that it may be moved into engagement with the back of the positioning member 340, thereby allowing the support member 350 to act in concert with the positioning member 340.

In operation, the centering member 330 and the support member 350 are initially in the unactuated position as illustrated in FIG. 25. The biasing member 370 positions the gripping means 347 of the positioning member 340 in the path of the drill pipe 105. As the powerframe moves the tong 1 towards the drill pipe 105, the roller 347 engages the drill pipe 105 before the drill pipe 105 reaches the center of the jaws.

Thereafter, the positioning member 340 is moved to the predetermined position as the tong 1 continues to move toward the drill pipe 105 in FIG. 26. As illustrated, the positioning member 340 moved independently of the centering and support members 330, 350. When the predetermined position is reached, the tong 1 is stopped and the piston and cylinder assembly 360 is actuated to move the centering member 330 into contact with the drill pipe 105.

FIG. 26 shows the positioning member 340 in the predetermined position and the centering member 330 in contact with the drill pipe 105. Because the drill pipe 105 is not centered, the centering member 330 contacts the drill pipe 105 prematurely. As a result, the centering member 330 has not rotated the gears 332, 352 sufficiently to cause the support member 350 to engage the positioning member 340. This is indicated by the gap that exists between the support member 350 and the positioning member 340.

To center the drill pipe 105, the tong 1 is moved closer to the drill pipe 105. This allows the centering member 330 and the support member 350 to rotate towards each other, thereby closing the gap between the positioning member 340 and the support member 350. The drill pipe 105 is centered when the gap closes and the support member 350 engages the positioning member 340 as illustrated in FIG. 27. In this position, the drill pipe 105 is centered between the positioning member 340 and the centering member 330.

When the drill pipe 105 is ready for release, the piston 360 is actuated to move the centering member 330 and the support member 350 away from the drill pipe 105 and back towards the unactuated position. Thereafter, the tong 1 moves away from the drill pipe 105. After the drill pipe 105 is released, the biasing member 370 moves the positioning member 340 to its initial position and ready for the next drill pipe 105. In this manner, the drill pipe 105 may be effectively and efficiently centered in the jaws of the tong 1.

According to another aspect of the present invention, the positioning tool 300 may further include a joint detection member 400 for detecting an axial position of a pipe joint 108. Generally, after the drill pipe 105 has been centered, the position of the pipe joint 108 must be determined to ensure that the tong 1 grips the pipe joint 108. Typically, a pipe joint 108 has an outer diameter that is larger than an out diameter of a pipe body 105. Thus, it is preferable for the tong 1 to grip the pipe joint 108 during makeup or breakup to minimize damage to the pipe 105.

In one embodiment, the joint detection member 400 may be integrated into the positioning tool 300 as illustrated in FIG. 28. In this respect, a proximity sensor 410 may be at least partially disposed in the housing 345 of the positioning member 340. The proximity sensor 410 is capable of detecting the relative distance of the pipe 105 from the sensor 410. The proximity sensor 410 may include a wire 420 to connect the proximity sensor 410 to a computer or other programmable device 430 known to a person of ordinary skill in the art. The positioning tool 300 may be pre-programmed with information regarding the drill pipe 105. The information may include the length of the pipe joint 108 and the outer diameters of the drill pipe 105 and the pipe joint 108.

When the centering and positioning members 330, 340 are in contact with the pipe joint 108, the housing 345 remains in a normal position as shown in FIG. 28. In this position, the proximity sensor 410 may detect the relative distance to the pipe joint 108. However, when the members 330, 340 are centered around the pipe body 105 as illustrated in FIG. 29, the programming allows the positioning tool 300 to recognize that the members 330, 340 are incorrectly positioned. As a result, the housing 345 and the proximity sensor 410 are tilted away from the drill pipe 105. When this occurs, the tong 1 is moved vertically relative to the drill pipe 105 until the members 330, 340 are centered around the pipe joint 108. Moreover, the proximity sensor 410 may be used to detect the interface 440 between the pipe joint 108 and the pipe body 105. The detected interface 440 is then used as a reference point for positioning the pipe joint 108 relative to the tong 1, thereby allowing the jaws to grip the pipe joint 108. In this manner, the pipe joint 108 may be properly positioned for makeup and/or breakup.

While the foregoing is directed to embodiments of the present invention, other and further embodiments of the invention may be devised without departing from the basic scope thereof, and the scope thereof is determined by the claims that follow.

We claim:

1. A method for positioning a tubular relative to a tong, comprising:

moving the tong towards the tubular until a positioning member contacts the tubular and the positioning member is moved into a predetermined position; and actuating a centering member until it contacts the tubular.

2. The method of claim 1, further comprising determining an axial position of a tubular joint of the tubular.

3. The method of claim 2, further comprising moving the tong vertically.

4. The method of claim 3, wherein determining the axial position of the tubular joint comprises detecting a distance to the tubular.

5. The method of claim 1, further comprising moving the tong until a support member engages the positioning member.

6. The method of claim 5, further comprising determining an axial position of a tubular joint of the tubular.

7. The method of claim 5, wherein the tubular is positioned in a center position relative to a gripping apparatus of the tong.

8. The method of claim 7, wherein the tubular is centered front-to-back relative to the gripping apparatus of the tong.

9. An apparatus for positioning a tubular relative to a tong, comprising:

a positioning member for establishing a position of the tubular relative to the tong and for engaging the tubular;

a centering member for adjusting the position of the tubular relative to the tong; and a support member cooperating with the centering member and for engaging the positioning member when the tubular is centered relative to the tong.

10. The apparatus of claim 9, wherein the tubular is centered front-to-back relative to a gripping apparatus of the tong.

11. The apparatus of claim 10, further comprising a joint detection member.

12. The apparatus of claim 11, wherein the joint detection member comprises a proximity sensor.

13. The apparatus of claim 9, wherein the centering member is coupled to the positioning member.

14. The apparatus of claim 13, wherein the positioning member and the centering member cooperate to center the tubular.

15. The apparatus of claim 14, further comprising an actuating member connected to the centering member.

16. The apparatus of claim 14, further comprising a biasing member for coupling the positioning member to the centering member.

17. The apparatus of claim 14, further comprising a joint detection member.

18. The apparatus of claim 17, wherein the joint detection member comprises a proximity sensor.

19. The apparatus of claim 18, wherein the proximity sensor is disposed in a housing of the positioning member.

20. An apparatus for positioning a tubular relative to a tong, comprising:

an engagement member for establishing a position of the tubular relative to the tong and for engaging the tubular, wherein the engagement member adjusts the position of the tubular relative to the tong;

an actuating member operatively connected to the engagement member, wherein the actuating member is coupled to the engagement member, the engagement member and the actuating member cooperate to center the tubular, and a support member; and a biasing member for coupling the engagement member to the actuating member.

21. An apparatus for positioning a tubular relative to a tong, comprising:

an engagement member for establishing a position of the tubular relative to the tong and for engaging the tubular, wherein the engagement member adjusts the position of the tubular relative to the tong;

an actuating member operatively connected to the engagement member, wherein the actuating member is coupled to the engagement member, the engagement member and the actuating member cooperate to center the tubular, and a distal end of the engagement and actuating members comprises a gripping member;

a support member; and a biasing member for coupling the engagement member to the actuating member.

22. The apparatus of claim 21, wherein the gripping member comprises a roller.

23. The apparatus of claim 21, wherein the distal end further comprises a housing for maintaining the gripping member.

24. An apparatus for positioning a tubular relative to a tong, comprising:

an engagement member for establishing a position of the tubular relative to the tong and for engaging the tubular, wherein the engagement member adjusts the position of the tubular relative to the tong;

an actuating member operatively connected to the engagement member, wherein the actuating member is coupled to the engagement member, the engagement member and the actuating member cooperate to center the tubular;

a support member; and a joint detection member, wherein the joint detection member comprises a proximity sensor, the proximity sensor is disposed in a housing of the engagement member, and the housing is movable relative to the tong.

25. The apparatus of claim 24, wherein moving the housing tilts the proximity sensor away from the tubular.

26. An apparatus for positioning a tubular relative to a tong, comprising:

a first member for determining a position of the tubular; and a second member for engaging the tubular, wherein the first member and the second member are movable to position the tubular in the center of the tong and the first member is independently movable relative to the second member.

27. The apparatus of claim 26, further comprising a support member, wherein the support member and the first member are rotatable about the same axis.

28. The apparatus of claim 26, further comprising a joint detection member.

29. The apparatus of claim 28, wherein the joint detection member comprises a proximity sensor.

30. The apparatus of claim 28, wherein the joint detection member is attached to the first member.

31. An apparatus for gripping a tubular, comprising:

a tong comprising one or more jaws; and a positioning apparatus for centering the tubular relative to the one or more jaws, the positioning apparatus comprising:

a first member for determining a positioning of the tubular;

a second member for engaging the tubular, wherein the first member and the second member are movable to position the tubular in the center of the one or more jaws, wherein the first member is independently movable relative to the second member, and the first member is coupled to the second member using a biasing member; and a support member, wherein the support member and the second member are rotatable about the same axis.

32. The apparatus of claim 31, wherein the first member is actuatable by a piston and cylinder assembly.

33. The apparatus of claim 32, wherein the first member and the second member further comprises one or more gripping means.

* * * * *

UNITED STATES PATENT AND TRADEMARK OFFICE

CERTIFICATE OF CORRECTION

PATENT NO. : 6,814,149 B2
DATED : November 9, 2004
INVENTOR(S) : Martin Liess et al.

It is certified that error appears in the above-identified patent and that said Letters Patent is hereby corrected as shown below:

Column 15,
Line 51, please insert -- the actuating member is independently movable relative to the engagement member; --

Signed and Sealed this

Seventh Day of June, 2005

JON W. DUDAS
*Director of the United States Patent and Trademark Office*